US009645529B2

(12) United States Patent
Onishi et al.

(10) Patent No.: US 9,645,529 B2
(45) Date of Patent: May 9, 2017

(54) IMAGE FORMING APPARATUS WITH COLOR MISREGISTRATION CORRECTION CONTROL

(71) Applicant: KONICA MINOLTA, INC., Chiyoda-ku (JP)

(72) Inventors: Jun Onishi, Hino (JP); Masahito Takano, Koganei (JP); Takashi Fujiwara, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 103 days.

(21) Appl. No.: 14/272,630

(22) Filed: May 8, 2014

(65) Prior Publication Data

US 2014/0334855 A1 Nov. 13, 2014

(30) Foreign Application Priority Data

May 9, 2013 (JP) ..... 2013-098942

(51) Int. Cl.
*G03G 15/01* (2006.01)
*G03G 15/16* (2006.01)
(Continued)

(52) U.S. Cl.
CPC ..... *G03G 15/1615* (2013.01); *G03G 15/505* (2013.01); *G03G 15/5008* (2013.01);
(Continued)

(58) Field of Classification Search
CPC ..... G03G 15/1615; G03G 15/5008; G03G 15/505; G03G 15/5054; G03G 15/5058;
(Continued)

(56) References Cited

U.S. PATENT DOCUMENTS

2004/0114951 A1* 6/2004 Kawagoe ..... G03G 15/162 399/66
2008/0247781 A1* 10/2008 Matsuda ..... G03G 15/161 399/162

FOREIGN PATENT DOCUMENTS

JP 09-175687 A 8/1997
JP 2001-034025 A 2/2001
(Continued)

OTHER PUBLICATIONS

Japanese Notification of Reason(s) for Refusal dated Jun. 2, 2015 issued in the corresponding Japanese Patent Application No. 2013-098942 and English translation (7 pages).

*Primary Examiner* — Ryan Walsh
(74) *Attorney, Agent, or Firm* — Buchanan Ingersoll & Rooney PC

(57) ABSTRACT

An image forming apparatus includes upstream-side and downstream-side detection parts and a control section. The detection parts are disposed on a moving path of an intermediate transfer belt or a conveyor belt and detect a speed of the belt. The control section performs control to correct color misregistration of images composed of colors to be formed on the intermediate transfer belt or a recording medium conveyed by the conveyance belt on the basis of the detection result. The control unit calculates a difference between the speed detected by the upstream-side detection part and the speed detected by the downstream-side detection part after a predetermined time elapses since the upstream-side detection part detects the speed and performs the control on the basis of the difference. The predetermined time is obtained by dividing a distance between the detection parts by a target speed of the belt.

16 Claims, 8 Drawing Sheets

(51) Int. Cl.
*G03G 21/14* (2006.01)
*G03G 15/00* (2006.01)

(52) U.S. Cl.
CPC ..... *G03G 15/5054* (2013.01); *G03G 15/5058* (2013.01); *G03G 21/14* (2013.01); *G03G 21/145* (2013.01); *G03G 2215/00599* (2013.01); *G03G 2215/0129* (2013.01); *G03G 2215/0158* (2013.01)

(58) Field of Classification Search
CPC ..... G03G 21/14; G03G 21/145; G03G 2215/00599; G03G 2215/0129; G03G 2215/0158
See application file for complete search history.

(56) References Cited

FOREIGN PATENT DOCUMENTS

| | | | |
|---|---|---|---|
| JP | 2005-024616 | A | 1/2005 |
| JP | 2005-037621 | A | 2/2005 |
| JP | 2005-091861 | A | 4/2005 |
| JP | 2005-156877 | A | 6/2005 |

* cited by examiner

IMAGE FORMING APPARATUS WITH COLOR MISREGISTRATION CORRECTION CONTROL

1. FIELD OF THE INVENTION

The present invention relates to an image forming apparatus.

2. DESCRIPTION OF THE RELATED ART

There has been known a tandem image forming apparatus having image forming units for colors, such as Y (yellow), M (magenta), C (cyan) and K (black), disposed side by side, forming toner images of the respective colors on photosensitive drums of the respective image forming units and successively transferring the toner images to form a color image composed of the colors (i.e. the toner images) on paper.

In such a tandem image forming apparatus, when the toner images of the respective colors are superposed on top of each other, in some cases, they are misaligned and accordingly color misregistration occurs. The main cause of the color misregistration is, for example, a non-constant speed of an intermediate transfer belt which successively conveys the toner images of the respective colors or a conveyor belt which conveys paper to the image forming units for the respective colors.

In order to reduce the color misregistration, according to, for example, Japanese Patent Application Laid-Open Publication No. 2005-24616 (Patent Document 1) or Japanese Patent Application Laid-Open Publication No. 2005-91861 (Patent Document 2), there is described detecting the speed of a plurality of points on a belt, calculating the average value of the detection results and performing belt drive control on the basis of the average value.

However, as described in Patent Document 1, when the belt speed is detected on the basis of rotational speeds of driven rollers which contact the belt by pressure, detection errors in the belt speed occur due to non-uniformity in thickness or frictional characteristics of the belt, change in the outer diameters of the driven rollers by temperature change, or the like. Therefore, the belt drive control based on the average value of the detection values of the belt speed alone cannot effectively reduce the color misregistration.

Further, as described in Patent Document 2, when the belt speed is detected on the basis of timings at which an encoder pattern disposed on a face of the belt passes through sensors, detection errors in the belt speed occur due to the initial accuracy of the pattern, change in the interval(s) between marks constituting the pattern caused, for example, by expansion/contraction of the belt by temperature change, or the like. Therefore, this cannot effectively reduce the color misregistration, either.

BRIEF SUMMARY OF THE INVENTION

Objects of the present invention include providing an image forming apparatus which reduces influence of detection errors in a belt speed on color misregistration which is caused by change in the belt speed and increases certainty in reducing the color misregistration.

In order to achieve at least one of the above-described objects, according to an aspect of the present invention, there is provided an image forming apparatus including: an image forming section including a plurality of image forming units disposed side by side along a moving direction of an intermediate transfer belt or a conveyor belt and successively forming images with the image forming units on the intermediate transfer belt or a recording medium conveyed by the conveyor belt; a plurality of detection parts disposed at a plurality of points on a moving path of the intermediate transfer belt or the conveyor belt and detecting a speed of the intermediate transfer belt or the conveyor belt; and a control section which performs control to correct color misregistration of the images composed of colors to be formed on the intermediate transfer belt or the recording medium conveyed by the conveyor belt on the basis of a detection result of the detection by the detection parts, wherein with respect to the speed detected by detection parts disposed at two points on the moving path among the plurality of detection parts, the control section (a) calculates a difference value between (i) the speed detected by the detection part disposed on an upstream side of the moving path and (ii) the speed detected by the detection part disposed on a downstream side of the moving path after a predetermined time elapses since the detection part on the upstream side detects the speed, the predetermined time being obtained by dividing a distance between the detection parts disposed at the two points by a target speed of the intermediate transfer belt or the conveyor belt, and (b) performs the control on the basis of the calculated difference value.

Preferably, in the image forming apparatus, an interval between the detection parts is $1/n_1$ (wherein $n_1$ is a positive integer) times an interval between writing points at which the image forming units form the images on the intermediate transfer belt or the recording medium conveyed by the conveyor belt.

Preferably, in the image forming apparatus, the detection parts detect rotational speeds of driven rollers which rotate following the intermediate transfer belt or the conveyor belt so as to detect the speed of the intermediate transfer belt or the conveyor belt on the basis of the detected rotational speeds.

Preferably, in the image forming apparatus, an outer circumference of each of the driven rollers is $1/n_2$ (wherein $n_2$ is a positive integer) times an interval between writing points at which the image forming units form the images on the intermediate transfer belt or the recording medium conveyed by the conveyor belt.

Preferably, in the image forming apparatus, contact angles of the driven rollers with the intermediate transfer belt or the conveyor belt at the detection parts are equal.

Preferably, in the image forming apparatus, the detection parts read a pattern formed on a belt face of the intermediate transfer belt or the conveyor belt so as to detect the speed of the intermediate transfer belt or the conveyor belt.

Preferably, in the image forming apparatus, the detection parts are disposed on a side of the moving path, the side where the image forming units are disposed, between a belt drive roller which drives the intermediate transfer belt or the conveyor belt and a belt tension adjustment mechanism which adjusts tension of the intermediate transfer belt or the conveyor belt.

Preferably, in the image forming apparatus, the control section controls the speed of the intermediate transfer belt or the conveyor belt on the basis of the difference value so as to correct the color misregistration.

Preferably, in the image forming apparatus, the control section controls image forming timings at which the image forming units form the images on the intermediate transfer belt or the recording medium conveyed by the conveyor belt so as to correct the color misregistration.

BRIEF DESCRIPTION OF THE SEVERAL VIEWS OF THE DRAWING

The present invention is fully understood from the detailed description given hereinafter and the accompanying drawings, which are given by way of illustration only and thus are not intended to limit the present invention, wherein.

DETAILED DESCRIPTION OF THE INVENTION

In the following, the configuration and operation of an image forming apparatus according to embodiments of the present invention are described with reference to the drawings.

First Embodiment

First, the configuration of a first embodiment is described.

Figure 1:
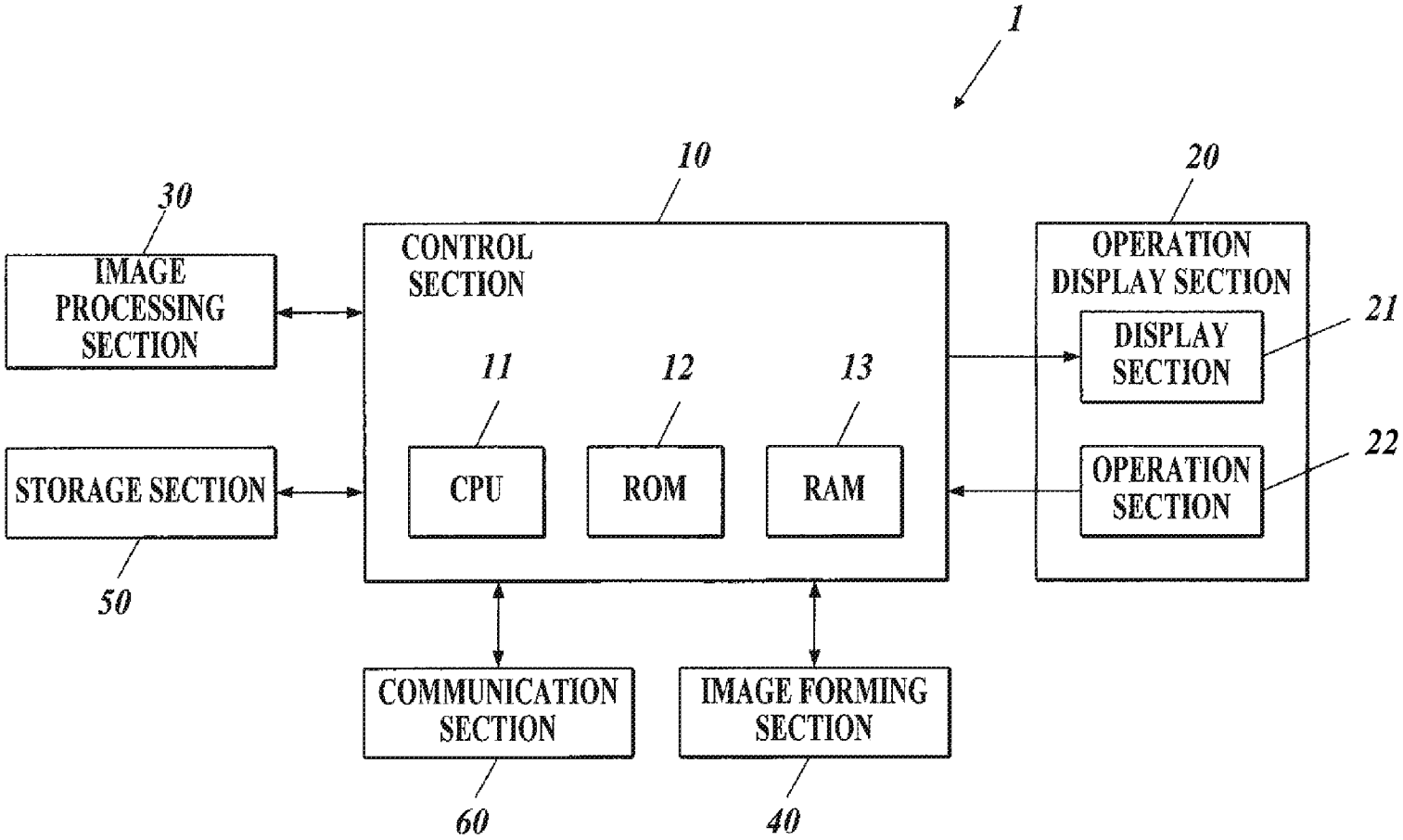
FIG. 1 is a block diagram showing the functional configuration of an image forming apparatus.

FIG. 1 is a block diagram showing the functional configuration of an image forming apparatus 1. The image forming apparatus 1 is a color image forming apparatus using the electrophotographic process technology. As shown in FIG. 1, the image forming apparatus 1 includes a control section 10, an operation display section 20, an image processing section 30, an image forming section 40, a storage section 50 and a communication section 60. These sections and the like are connected to each other via a not-shown bus.

The control section 10 includes a CPU (Central Processing Unit) 11, a ROM (Read Only Memory) 12 and a RAM (Random. Access Memory) 13. The CPU 11 of the control section 10 reads a system program and a processing program(s) from various processing programs stored in the ROM 12 and opens the read programs in the RAM 13 so as to perform centralized control of operations of the sections and the like of the image forming apparatus 1 in accordance with the opened programs.

The operation display section 20 includes a display section 21 and an operation section 22.

The display section 21 is composed of an LCD (Liquid Crystal Display) or the like and displays various operation buttons, the state of the apparatus, operation statuses of various functions and the like on a display screen in accordance with instructions of display signals input from the control section 10.

The operation section 22 includes various keys such as numeric keys and a start key, and receives user's key operations and outputs operation signals corresponding to the key operations to the control section 10. The operation section 22 also includes a pressure-sensitive (resistive) touch panel, in which transparent electrodes are disposed in a lattice in such a way as to cover the upper face of the LCD of the display section 21. X and Y coordinates of points which are pressed by a finger, a touch pen or the like are detected as voltage values, and position signals corresponding to the detected voltage values are output as the operation signals to the control section 10. The touch panel is not limited to the pressure-sensitive touch panel, and hence may be a capacitive touch panel, an optical touch panel or the like.

The image processing section 30 performs shading correction, color conversion, gradation correction, gradation reproduction (screening or error diffusion) or the like on input image data (density gradation data) input thereto via the communication section 60 or the like, and outputs the image data to the image forming section 40.

The image forming section 40 forms images on sheets of paper by electrophotography on the basis of the image data input from the image processing section 30. In the embodiments, the image forming section 40 uses color toners of four colors, namely, yellow, magenta, cyan and black, so as to form color images composed of the colors.

Figure 2:
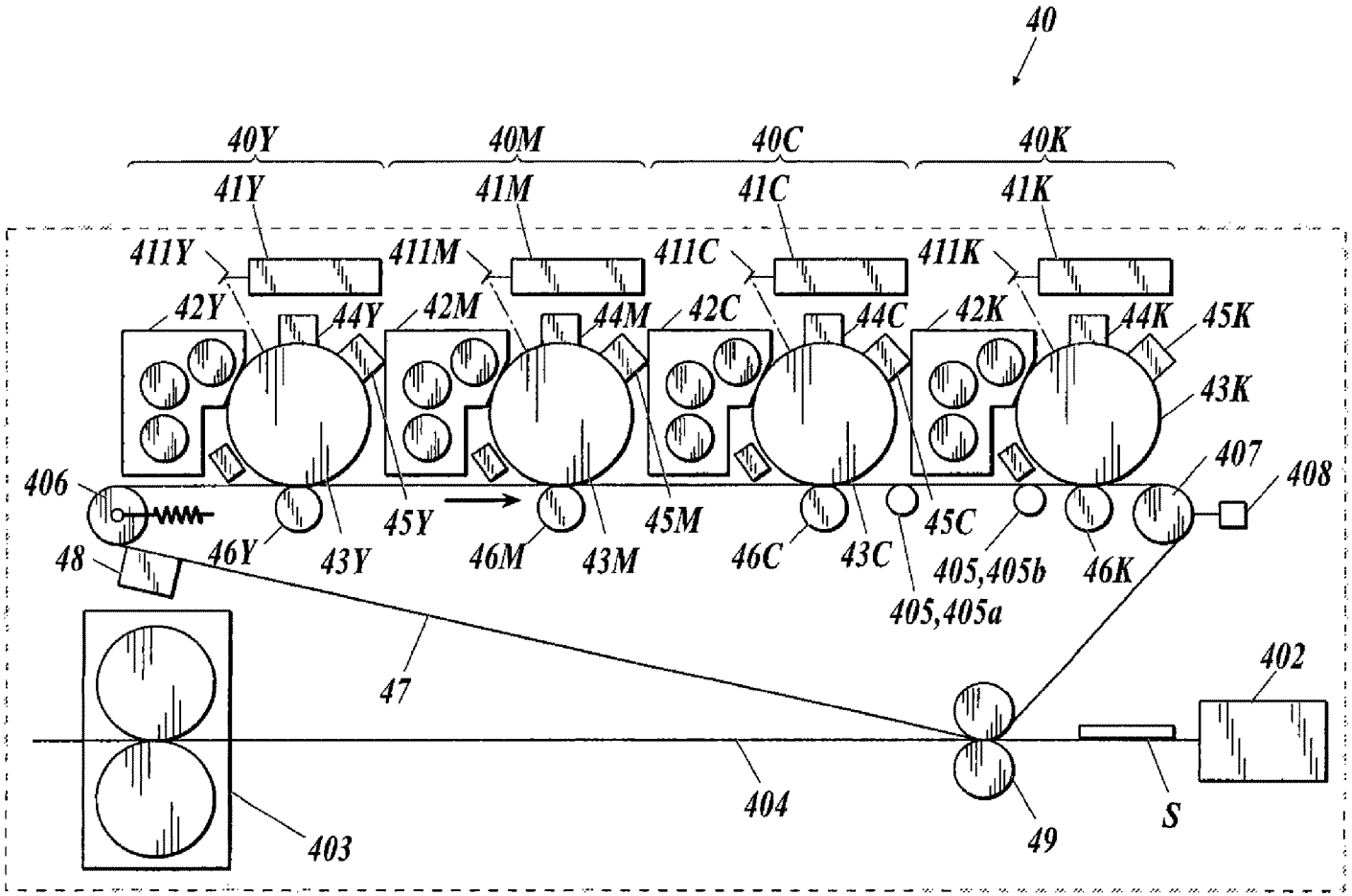
FIG. 2 is a schematic view showing an example of the configuration of an image forming section.

FIG. 2 is a schematic view showing the configuration of the image forming section 40.

As shown in FIG. 2, the image forming section 40 includes image forming units 40Y, 40M, 40C and 40K, an intermediate transfer belt 47 as an intermediate transfer body, a cleaner part 48, a secondary transfer roller 49, a paper feeder part 402, a fixing unit 403, a conveyor part 404, driven rollers 405 (405*a* and 405*b*), a belt tension adjustment mechanism 406, a belt drive roller 407 and a belt drive motor 408. The "Y", "M", "C" and "K" following the reference numeral of the units represent colors of toners used in the units, namely, yellow, magenta, cyan and black, respectively. The driven roller 405 on the upstream side and the driven roller 405 on the downstream side of a moving path along which the intermediate transfer belt 47 moves are referred to as a driven roller 405*a* and a driven roller 405*b*, respectively. However, where it is unnecessary to distinguish them from each other, they are simply referred to as driven rollers 405.

The image forming units 40Y, 40M, 40C and 40K include exposure units 41Y, 41M, 41C and 41K, developer units 42Y, 42M, 42C and 42K, photosensitive drums 43Y, 43M, 43C and 43K, charger parts 44Y, 44M, 44C and 44K, cleaner parts 45Y, 45M, 45C and 45K, and primary transfer rollers 46Y, 46M, 46C and 46K as transfer members, respectively. The image forming units 40Y, 40M, 40C and 40K are, as shown in FIG. 2, disposed along a moving direction of the intermediate transfer belt 47 side by side at intervals of a predetermined distance.

Each of the exposure units 41Y, 41M, 41C and 41K includes a laser light source, such as an LD (Laser Diode), a polygon mirror (polygon mirror 411Y, 411M, 411C or 411K) and a plurality of lenses. The exposure units 41Y, 41M, 41C and 41K scan and expose the surfaces of the photosensitive drums 43Y, 43M, 43C and 43K with laser beams, respectively, on the basis of the image data sent from the image processing section 30. By the scan and exposure with the laser beams, latent images are formed on the photosensitive drums 43Y, 43M, 43C and 43K charged by the charger parts 44Y, 44M, 44C and 44K, respectively.

The latent images formed on the photosensitive drums 43Y, 43M, 43C and 43K are developed by the developer units 42Y, 42M, 42C and 42K making toners of their respective colors adhere to the latent images on the photosensitive drums 43Y, 43M, 43C and 43K, respectively. Consequently, yellow, magenta, cyan and black toner images are formed on the photosensitive drums 43Y, 43M, 43C and 43K, respectively.

The toner images formed on and held by the photosensitive drums 43Y, 43M, 43C and 43K are successively transferred to a predetermined point on the intermediate transfer belt 47 by the primary transfer rollers 46Y, 46M, 46C and 46K, respectively, to which a predetermined voltage is applied from a not-shown power source, whereby primary transfer is performed. The remaining toners on the surfaces of the photosensitive drums 43Y, 43M, 43C and 43K, which finish transferring the toner images to the intermediate transfer belt 47, are removed by the cleaner parts 45Y, 45M, 45C and 45K, respectively.

The intermediate transfer belt 47 is a semiconductive endless belt hanging around and held by a plurality of rollers in such away as to be rotatable. The intermediate transfer belt 47 rotates as the rollers rotate.

The intermediate transfer belt 47 is pressed to the photosensitive drums 43Y, 43M, 43C and 43K by the primary transfer rollers 46Y, 46M, 46C and 46K, which face the photosensitive drums 43Y, 43M, 43C and 43K, respectively. A transfer current for the voltage applied to the primary transfer rollers 46Y, 46M, 46C and 46K flows through the primary transfer rollers 46Y, 46M, 46C and 46K. Consequently, the toner images developed on the surfaces of the photosensitive drums 43Y, 43M, 43C and 43K are successively transferred (primary transfer) to the intermediate transfer belt 47 by the primary transfer rollers 46Y, 46M, 46C and 46K, respectively.

In the paper feeder part 402 and the conveyor part 404, a sheet ("S" in FIG. 2) of paper, the type of which is specified by the control section 10, is fed from the paper feeder part 402, and the fed sheet is conveyed by the conveyor part 404 to a transfer point where secondary transfer is performed by the secondary transfer roller 49. A color toner image of the toner images is transferred (secondary transfer) to the sheet by the secondary transfer roller 49. After the secondary transfer, the sheet is conveyed to the fixing unit 403 so that the color toner image, which is transferred to the sheet, is fixed by heat. The remaining toners on the intermediate transfer belt 47 are removed by the cleaner part 48.

The storage section 50 is composed of a nonvolatile semiconductor memory, an HDD (Hard Disc Drive) or the like, and stores, for example, the system program executable by the image forming apparatus 1, the processing programs executable by the system program, data used to execute the processing programs, and data of results of arithmetic processing performed by the control section 10.

The communication section 60 includes a modem, a LAN adapter and a router. The communication section 60 controls communications with an external apparatus, such as a PC (Personal Computer), connected to a communication network, such as a LAN (Local Area Network) or a WAN (Wide Area Network), so as to receive image data and the like from the external apparatus, for example.

Next, color misregistration correction control in the image forming apparatus 1 is described.

In a conventional image forming apparatus, the speed of an intermediate transfer belt or a conveyor belt is controlled to be constant, whereby change in the belt speed affected by disturbance is reduced, and color misregistration is corrected. Examples of the disturbance which affects the belt speed include change in a load applied to the belt when the belt moves caused by change in the cleaning state of the belt or the like, non-uniformity in thickness of the belt, change in a coefficient of friction μ between the belt and a belt drive roller caused by dirt on the back face of the belt or change in the condition of the belt, change in the diameter of the belt drive roller caused by expansion/contraction thereof by temperature change, change in the length of the belt between the belt drive roller and a primary transfer roller caused by paper passing therethrough, and change in the length of the belt between primary transfer rollers for respective colors caused by expansion/contraction of the framework by temperature change. However, in the case where the belt speed is detected on the basis of rotational speeds of driven rollers, the belt speed cannot be accurately detected because of, for example, a detection error(s) in the belt speed resulting from points on the belt, such as the detection error caused by non-uniformity in thickness of the belt or the like.

Figure 3:
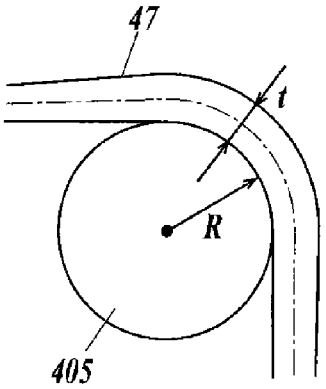
FIG. 3 shows a relationship between an intermediate transfer belt and a driven roller.

FIG. 3 shows a relationship between the intermediate transfer belt 47 and the driven roller 405. As shown in FIG. 3, in the case where the contact length of the driven roller 405 with the intermediate transfer belt 47 is not short enough, a relationship between the belt speed V of the intermediate transfer belt 47 and the angular velocity ω of the driven roller 405 is expressed by $V=\omega\times(R+t/2)$ (first formula) wherein R represents the radius of the driven roller 405, and t represents the thickness of the intermediate transfer belt 47 at a contact point with the driven roller 405, and hence the belt speed V is assumed to depend on a local thickness of the intermediate transfer belt 47. That is, even when the belt drive roller 407 is rotated at a constant angular velocity ω, the belt speed V changes by being affected by non-uniformity in thickness of the intermediate transfer belt 47. Similarity, even when the belt speed V is constant, the angular velocity ω of the driven roller 405 changes by being affected by non-uniformity in thickness of the intermediate transfer belt 47, and a detection error(s) in the belt speed V occurs.

Therefore, the belt speed control based on detection values of the speed of the intermediate transfer belt 47 with the driven rollers 405 or the average value thereof cannot reduce the color misregistration with high certainty.

Then, in the image forming apparatus 1 of the embodiment, the speed of an approximately same point on the intermediate transfer belt 47 is detected by the driven rollers 405*a* and 405*b* disposed at two points on the moving path of the intermediate transfer belt 47, and the difference value ΔV between the detection values obtained by the driven rollers 405*a* and 405*b* cancels the detection error contained in the detection values. The color misregistration of the toner images formed on the intermediate transfer belt 47 is corrected by controlling the speed of the intermediate transfer belt 47 on the basis of the difference value ΔV.

Figure 4:
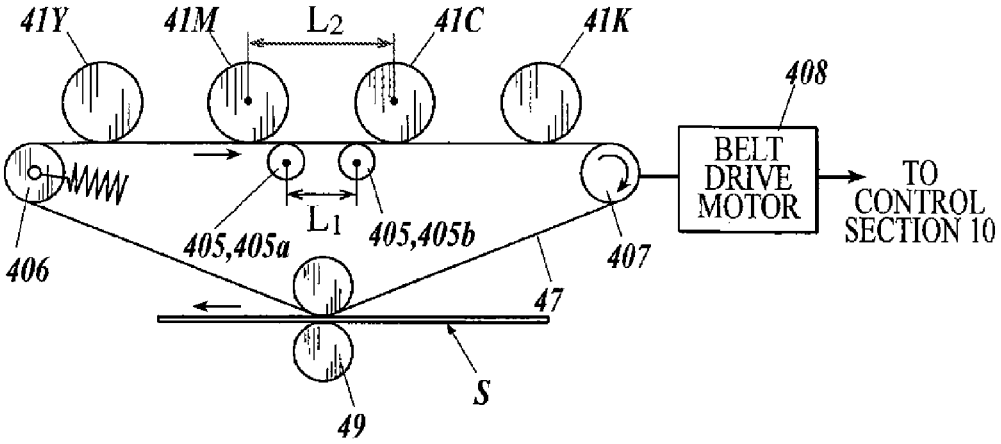
FIG. 4 shows the configuration of the main part of the image forming section in first and second embodiments in a simplified form, the main part being related to color misregistration correction control.

FIG. 4 shows the configuration of the main part of the image forming section 40 in a simplified form, the main part being related to the color misregistration correction control. In the image forming apparatus 1 of the embodiment, the driven rollers 405*a* and 405*b* are disposed at two points on the moving path of the intermediate transfer belt 47 as belt speed detection parts. It is preferable that the driven rollers 405*a* and 405*b* be disposed on a side of the moving path of the intermediate transfer belt 47 between the belt tension adjustment mechanism 406 and the belt drive roller 407, the side where the image forming units 40Y, 40M, 40C and 40K are disposed. Because the color misregistration occurs on this side of the moving path of the intermediate transfer belt 47, the side where the image forming units 40Y, 40M, 40C and 40K are disposed, the color misregistration can be corrected at higher accuracy by performing the color misregistration correction control on the basis of the belt speed detected at points on this side.

Each driven roller 405 is provided with: an encoder or a sensor which generates a signal at each rotation and is disposed on a roller shaft; and an arithmetic unit which detects the angular velocity ω of the driven roller 405 on the basis of the signal from the encoder or the sensor, calculates the speed V of the intermediate transfer belt 47 on the basis of the detected angular velocity ω and outputs the result as a detection value. The arithmetic unit for the driven roller 405 is connected with the control section 10 via a signal line so that the detection value is input to the control section 10.

Figure 5:
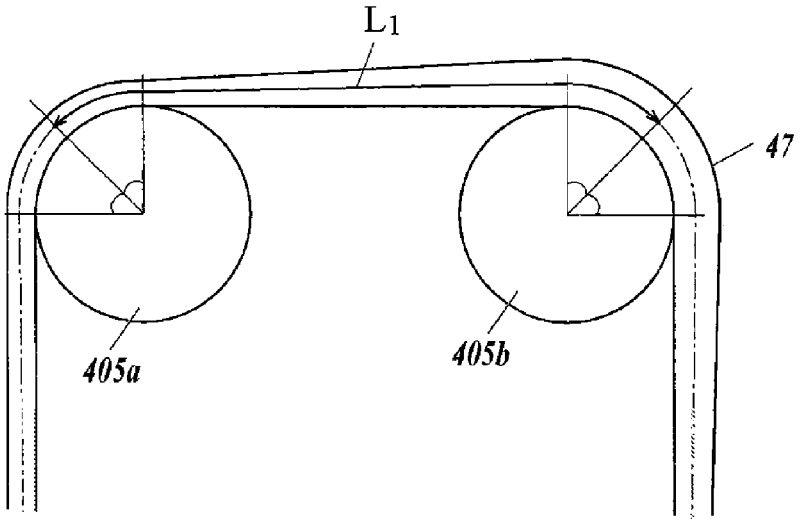
FIG. 5 shows an example of an arrangement of driven rollers at two points.

As shown in FIG. 5, it is preferable that the contact length (contact angle) of the driven roller 405*a* with the intermediate transfer belt 47 and the contact length of the driven roller 405*b* with the intermediate transfer belt 47 be the same. For example, if the contact length of the driven roller 405*a* with the intermediate transfer belt 47 is very short (almost no contact length) as shown in FIG. 4 and the contact length of the driven roller 405*b* with the intermediate transfer belt 47 is long as shown in FIG. 3, the angular velocity ω detected by the driven roller 405*a* having a very short contact length with the intermediate transfer belt 47 is hardly affected by the thickness of the intermediate transfer belt 47 whereas the angular velocity ω detected by the driven roller 405*b* having a long contact length with the intermediate transfer belt 47 is affected by the thickness of the intermediate transfer belt 47 as expressed by the above first formula. As a result, the angular velocities ω detected by the driven rollers 405*a* and 405*b* are different from each other even when the speed V of the intermediate transfer belt 47 is constant. FIGS. 2 and 4 show that the driven rollers 405 each have a very short (almost no) contact length (contact angle) with the intermediate transfer belt 47. However, when the image forming section 40 operates, nips are formed by the photosensitive drums 43Y, 43M, 43C and 43K and their respective primary transfer rollers 46Y, 46M, 46C and 46K. Hence, the driven rollers 405 each have some contact length with the intermediate transfer belt 47.

Figure 6:
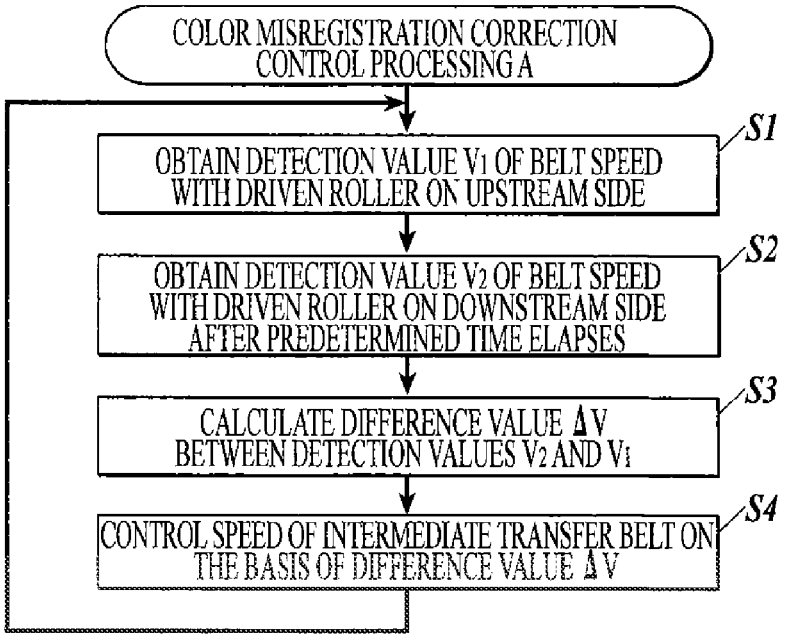
FIG. 6 is a flowchart of color misregistration correction control processing A performed by a control section shown in FIG. 1.

FIG. 6 is a flowchart of color misregistration correction control processing A performed by the control section 10. The color misregistration correction control processing A shown in FIG. 6 is repeatedly performed from the time the image forming section 40 starts operating until the time the image forming section 40 stops operating.

First, the control section 10 obtains a detection value $V_1$ with the driven roller 405*a* on the upstream side of the moving path of the intermediate transfer belt 47 (Step S1). Next, the control section 10 obtains a detection value $V_2$ with the driven roller 405*b* after a predetermined time dt elapses since the driven roller 405*a* detects the belt speed to obtain the detection value $V_1$ (Step S2). The predetermined time dt is calculated by dividing the interval (distance) $L_1$ between the belt speed detection parts (in the embodiment, the driven rollers 405*a* and 405*b*) disposed at two points and used for the detection by a target speed of the intermediate transfer belt 47 and is an expected value of the time required for the approximately same point on the intermediate transfer belt 47 to move from a belt speed detection part disposed at one point to a belt speed detection part disposed at the other point. That is, through Steps S1 and S2, the detection values of the belt speed of the approximately same point on the intermediate transfer belt 47 detected at two different points on the moving path of the intermediate transfer belt 47 can be obtained.

Next, the control section 10 calculates the difference value ΔV between the detection value $V_1$ and the detection value $V_2$ (in the embodiment, $\Delta V=V_2-V_1$) (Step S3) and controls the speed of the intermediate transfer belt 47 on the basis of the difference value ΔV (Step S4). At Step S4, for example, the control section 10 calculates for the belt drive motor 408 a PWM duty cycle with which the difference value ΔV becomes a target difference value of 0 by PID control or the like, and drives the belt drive motor 408 at the calculated PWM duty cycle to control the rotational speed of the belt drive roller 407, thereby controlling the speed of the intermediate transfer belt 47. That is, the speed of the intermediate transfer belt 47 is controlled in such a way that the difference value ΔV is 0. The control section 10 performs Steps S1 to S4 of the color misregistration correction control processing A within a very short control period (for example, about 0.6 msec) repeatedly.

Thus, in the color misregistration correction control processing A shown in FIG. 6, the speed of the intermediate transfer belt 47 is detected with a time difference of the predetermined time dt by the driven rollers 405*a* and 405*b* disposed at two points on the moving path of the intermediate transfer belt 47, and the speed of the intermediate transfer belt 47 is controlled on the basis of the difference value ΔV between the obtained detection values $V_1$ and $V_2$, whereby the color misregistration of the toner images formed on the intermediate transfer belt 47 is corrected. The predetermined time dt is the expected value of the time required for the approximately same point on the intermediate transfer belt 47 to move from the driven roller 405*a* to the driven roller 405*b*. That is, in the color misregistration correction control processing A, the speed of the approximately same point on the intermediate transfer belt 47 is detected by the driven rollers 405 disposed at two points, and the speed of the intermediate transfer belt 47 is controlled on the basis of the difference value ΔV between the obtained detection values $V_1$ and $V_2$. The difference value ΔV between the detection values $V_1$ and $V_2$ of the speed of the approximately same point on the intermediate transfer belt 47 can cancel the detection error in the detection values $V_1$ and $V_2$ resulting from points on the intermediate transfer belt 47 and/or the detection error therein caused by change which takes time longer than the predetermined time dt. Consequently, influence of the detection errors in the belt speed on the color misregistration is reduced, and the certainty in reducing the color misregistration is increased.

Examples of the detection error resulting from points on the belt include the above-described detection error caused by non-uniformity in thickness of the intermediate transfer belt 47 and the detection error caused by change in a coefficient of friction μ between the intermediate transfer belt 47 and the driven roller(s) 405 by dirt on the back face of the intermediate transfer belt 47.

Examples of the detection error caused by change which takes time longer than the predetermined time dt include the detection error caused by change in a coefficient of friction μ between the intermediate transfer belt 47 and the driven roller(s) 405 by change in the condition of the intermediate transfer belt 47 over time and the detection error caused by change in the diameter of the driven roller(s) 405 caused by expansion/contraction thereof by temperature change.

When the color misregistration correction control is performed on the basis of the difference value ΔV between the detection value $V_1$ of the belt speed detected by the driven roller 405*a* and the detection value $V_2$ of the belt speed detected by the driven roller 405*b* after the predetermined time dt, the color misregistration correction control is ineffective against variation components having an interval (in the embodiment, the predetermined time dt) of the detection times of the driven rollers 405*a* and 405*b* as a cycle period and their harmonics (components repeated at 1/n (wherein n is a positive integer) times the interval between the detection times of the driven rollers 405*a* and 405*b*). This is because these variation components are not expressed in the difference value ΔV. However, by making the interval $L_1$ between the driven rollers 405*a* and 405*b*, which is shown in FIG. 4, $1/n_1$ (wherein $n_1$ is a positive integer) times a photosensitive drum interval(s) (the interval(s) between writing points at which the image forming units 40Y, 40M, 40C and 40K write/form images on the intermediate transfer belt 47, hereinafter "an image forming interval") $L_2$, the variation components can be made to be components having periodicity of the image forming interval $L_2$ and not affecting the color misregistration. Hence, it is preferable that the interval $L_1$ between the driven rollers 405*a* and 405*b* be $1/n_1$ (wherein $n_1$ is a positive integer) times the image forming interval $L_2$. The smaller the value of $n_1$ is, the better it is. This is because as the value of $n_1$ is smaller, the color misregistration correction can be controlled at higher accuracy. The interval $L_1$ between the driven rollers 405 is, as shown in FIG. 5, based on the middle points of the respective lengths which the driven rollers 405 contact the intermediate transfer belt 47 (i.e. based on the points at each of which the contact length of the driven roller 405 with the intermediate transfer belt 47 is divided into two equal lengths). The same applies to the photosensitive drum interval $L_2$.

Similarly, by making the circumference of each driven roller 405 $1/n_2$ (wherein $n_2$ is a positive integer) times the image forming interval $L_2$, the detection errors caused by eccentricity of the driven roller(s) 405 and the like can be made to be components having periodicity of the image forming interval $L_2$ and not affecting the color misregistration. Hence, it is preferable that the circumference of each driven roller 405 be $1/n_2$ (wherein $n_2$ is a positive integer) times the image forming interval $L_2$.

Second Embodiment

In the following, a second embodiment of the present invention is described.

In the first embodiment, the color misregistration is corrected by controlling the speed of the intermediate transfer belt 47 on the basis of the difference value ΔV between the detection values of the speed of the intermediate transfer belt 47 detected with a time difference of the predetermined time dt by the driven rollers 405*a* and 405*b*. However, in the second embodiment, the color misregistration is corrected by controlling image forming timings at which the image forming units 40Y, 40M, 40C and 40K form images on the intermediate transfer belt 47 on the basis of the difference value ΔV.

The configuration of the second embodiment is the same as that of the image forming apparatus 1 described in the first embodiment with reference to FIGS. 1 to 5. Hence, the description thereof is omitted here, and color misregistration correction control processing in the second embodiment is described in the following.

Figure 7:
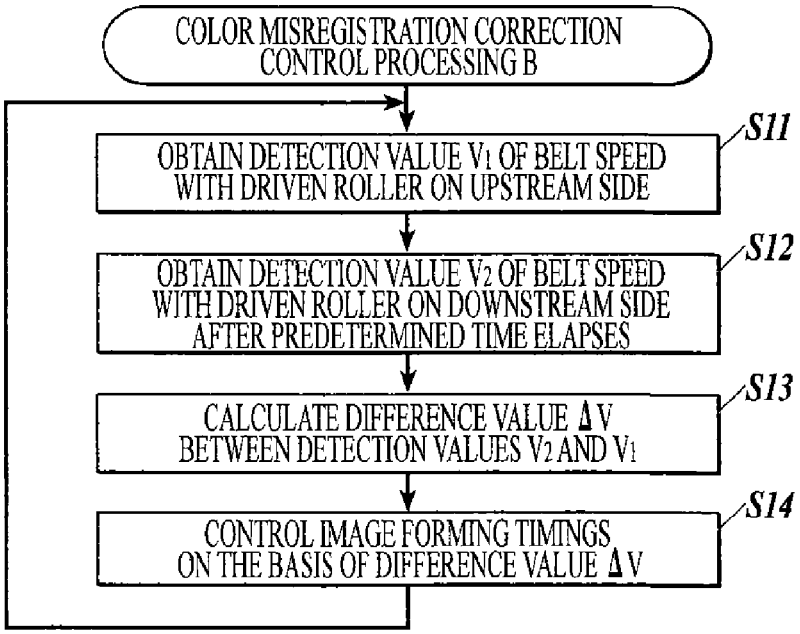
FIG. 7 is a flowchart of color misregistration correction control processing B performed by the control section shown in FIG. 1.

FIG. 7 is a flowchart of color misregistration correction control processing B performed by the control section 10 in the second embodiment. The color misregistration correction control processing B shown in FIG. 7 is repeatedly performed from the time the image forming section 40 starts operating until the time the image forming section 40 stops operating.

First, the control section 10 takes Steps S11 to S13. Steps S11 to S13 are the same as Steps S1 to S3 shown in FIG. 6, respectively. Hence, the description thereof is omitted here.

At Step S14, the control section 10 controls the image forming timings of the image forming units 40Y, 40M, 40C and 40K on the basis of the difference value ΔV (Step S14). The image forming timings are controllable, for example, by controlling irradiated points on the photosensitive drums 43Y, 43M, 43C and 43K, the irradiated points to which the exposure units 41Y, 41M, 41C and 41K emit laser beams, and the rotational speeds of the photosensitive drums 43Y, 43M, 43C and 43K. For example, when the detection value $V_2$ is more than the detection value $V_1$ (the difference value ΔV is positive), on the basis of the difference value ΔV, the rotational speeds of the photosensitive drums 43M, 43C and 43K are controlled to be more than their respective predetermined speeds, and the irradiated points on the photosensitive drums 43M, 43C and 43K, the irradiated points to which the exposure units 41M, 41C and 41K emit laser beams, are controlled to move in the rotational directions of the photosensitive drums 43M, 43C and 43K. On the other hand, when the detection value $V_2$ is less than the detection value $V_1$ (the difference value ΔV is negative), on the basis of the difference value ΔV, the rotational speeds of the photosensitive drums 43M, 43C and 43K are controlled to be less than their respective predetermined speeds, and the irradiated points on the photosensitive drums 43M, 43C and 43K, the irradiated points to which the exposure units 41M, 41C and 41K emit laser beams, are controlled to move in directions opposite to the rotational directions of the photosensitive drums 43M, 43C and 43K. How much more (or less) than their respective predetermined speeds the rotational speeds of the photosensitive drums 43M, 43C and 43K are made to be is calculated on the basis of the difference value ΔV. The irradiated points on the photosensitive drums 43M, 43C and 43K, the irradiated points to which the exposure units 41M, 41C and 41K emit laser beams, are moved by changing angles of the polygon mirrors 411M, 411C and 411K shown in FIG. 2 and/or by changing laser emission angles from the exposure units 41M, 41C and 41K.

The control section 10 performs Steps S11 to S14 of the color misregistration correction control processing B within a very short control period (for example, about 0.6 msec) repeatedly.

It is not essential to change both the rotational speeds of the photosensitive drums 43M, 43C and 43K and the irradiated points with laser beams in order to control the image forming timings. For example, even when only the irradiated points with laser beams are controlled to change, the color misregistration correction effect is obtained.

Thus, in the color misregistration correction control processing B shown in FIG. 7, the speed of the intermediate transfer belt 47 is detected with a time difference of the predetermined time dt by the driven rollers 405*a* and 405*b* disposed at two points, and the image forming timings are controlled on the basis of the difference value ΔV between the obtained detection values $V_1$ and $V_2$, whereby the color misregistration of the toner images formed on the intermediate transfer belt 47 is corrected. That is, in the color misregistration correction control processing B, the speed of the approximately same point on the intermediate transfer belt 47 is detected by the driven rollers 405 disposed at two points, and the image forming timings are controlled on the basis of the difference value ΔV between the obtained detection values $V_1$ and $V_2$. The difference value ΔV between the detection values $V_1$ and $V_2$ of the speed of the approximately same point on the intermediate transfer belt 47 can cancel the detection error in the detection values $V_1$ and $V_2$ resulting from points on the intermediate transfer belt 47 and/or the detection error caused by change which takes time longer than the predetermined time dt. Consequently, influence of the detection errors in the belt speed on the color misregistration is reduced, and the certainty in reducing the color misregistration is increased.

Examples of the detection error resulting from points on the belt and examples of the detection error caused by change which takes time longer than the predetermined time dt are the same as those described in the first embodiment.

It is preferable that the interval $L_1$ between the driven rollers 405*a* and 405*b* be $1/n_1$ (wherein $n_1$ is a positive integer) times the image forming interval $L_2$, as with the first embodiment. Also, it is preferable that the circumference of each driven roller 405 be $1/n_2$ (wherein $n_2$ is a positive integer) times the image forming interval $L_2$, as with the first embodiment.

In the first and second embodiments, the driven rollers 405 are disposed at two points, the driven roller 405*a* at one point and the driven roller 405*b* at the other point. However, the driven rollers 405 may be disposed at three or more points. Then, it is possible that the driven rollers 405 disposed at two points used for the color misregistration correction control are selected from among all the disposed driven rollers 405 with the operation section 22, and the above-described color misregistration correction control processing A or B is performed by using the selected driven rollers 405 disposed at two points.

Third Embodiment

In the following, a third embodiment of the present invention is described.

In the first embodiment, the speed of the intermediate transfer belt 47 is detected by using the driven rollers 405. However, in the third embodiment, the speed of the intermediate transfer belt 47 is detected by using an encoder pattern.

Figure 8:
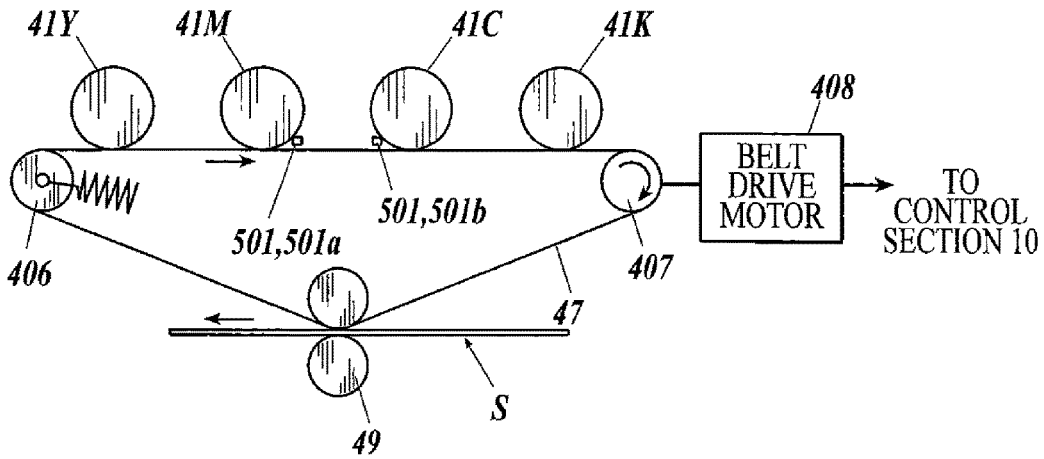
FIG. 8 shows the configuration of the main part of the image forming section in third and fourth embodiments in a simplified form, the main part being related to color misregistration correction control.
Figure 9:
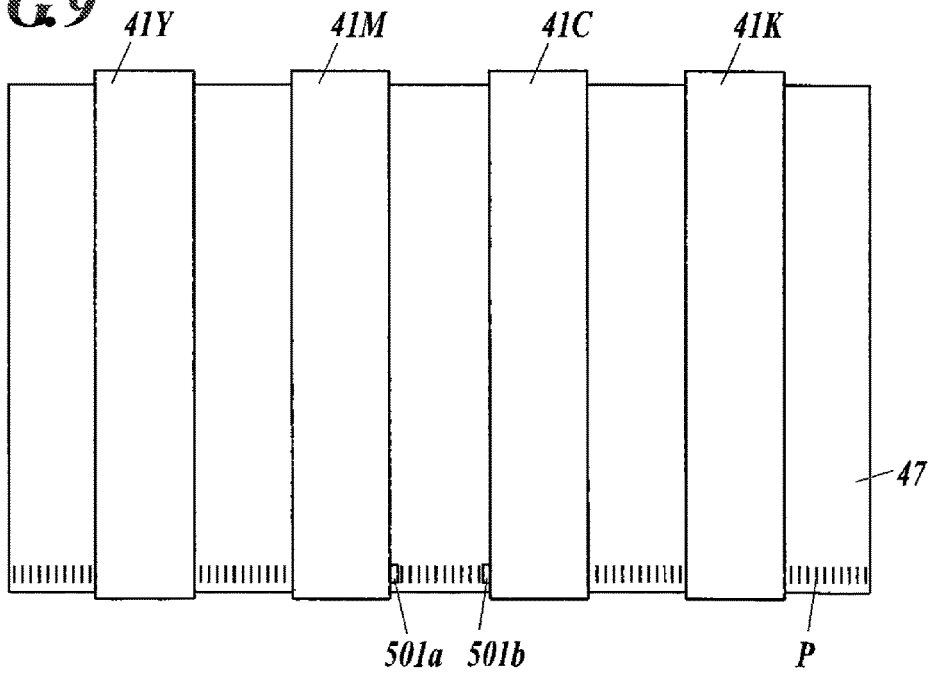
FIG. 9 shows the main part of the image forming section shown in FIG. 8 from above.

The different points in configuration between an image forming apparatus in the third embodiment and the image forming apparatus 1 in the first embodiment are that, in the third embodiment, as shown in FIG. 8, instead of the driven rollers 405*a* and 405*b*, belt speed detection parts 501 (a belt speed detection part 501*a* and a belt speed detection part 501*b* disposed on the upstream side and the downstream side of the moving path of the intermediate transfer belt 47, respectively) are disposed at two points on the side of the moving path of the intermediate transfer belt 47 between the belt tension adjustment mechanism 406 and the belt drive roller 407, the side where the image forming units 40Y, 40M, 40C and 40K are disposed, and, as shown by a top view of FIG. 9, an encoder pattern P is formed on the intermediate transfer belt 47.

Each belt speed detection part 501 is connected with the control section 10 via a signal line, and reads the encoder pattern P to detect the speed of the intermediate transfer belt 47 and outputs the result as a detection value to the control section 10. For example, each belt speed detection part 501 includes: a sensor which reads patterns (marks) constituting the encoder pattern P; a timer part which measures the time at which each of two marks is detected by the sensor; and an arithmetic unit which detects the speed of the intermediate transfer belt 47 by dividing the distance between the two marks (stored in a memory of the belt speed detection part 501 in advance) by a time required for the detection (the difference between the detection times of the two marks) and outputs the result as a detection value to the control section 10.

Other than these, the configuration of the image forming apparatus in the third embodiment is the same as that of the image forming apparatus 1 shown in FIGS. 1 to 5. Hence, the description thereof is omitted here, and the same reference numerals are given to the same sections and the like.

Figure 10:
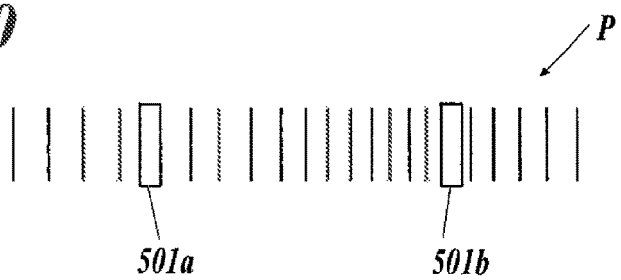
FIG. 10 shows an encoder pattern enlarged.

When the speed of the intermediate transfer belt 47 is detected by using the encoder pattern P, for example, as shown in FIG. 10 by enlargement, if the intervals of the marks constituting the encoder pattern P are not constant because of, for example, the initial accuracy of the encoder pattern P or expansion/contraction of the intermediate transfer belt 47 by temperature change, the detection error occurs and the belt speed cannot be accurately detected.

Then, in the image forming apparatus of the third embodiment, the speed of the intermediate transfer belt 47 is detected with a time difference of the predetermined time dt by the belt speed detection parts 501*a* and 501*b* disposed at two points on the moving path of the intermediate transfer belt 47, and the difference value ΔV between the detection values cancels the detection error contained in the detection values. The color misregistration of the toner images formed on the intermediate transfer belt 47 is corrected on the basis of the difference value ΔV. Its specific control flow is the same as the flow shown by the flowchart of the color misregistration correction control processing A described in the first embodiment except that the driven roller 405*a* on the upstream side and the driven roller 405*b* on the downstream side are replaced by the belt speed detection part 501*a* on the upstream side and the belt speed detection part 501*b* on the downstream side, respectively.

Thus, in the color misregistration correction control processing in the third embodiment, the speed of the intermediate transfer belt 47 is detected with a time difference of the predetermined time dt by the belt speed detection parts 501 disposed at two points on the moving path of the intermediate transfer belt 47, and the speed of the intermediate transfer belt 47 is controlled on the basis of the difference value ΔV, whereby the color misregistration of the toner images formed on the intermediate transfer belt 47 is corrected. That is, on the basis of the difference value ΔV between the detection values $V_1$ and $V_2$ of the speed of the approximately same point on the intermediate transfer belt 47 detected by the belt speed detection parts 501 disposed at two points, the speed of the intermediate transfer belt 47 is controlled in such a way that the difference value ΔV is 0, for example. The difference value ΔV between the detection values $V_1$ and $V_2$ of the speed of the approximately same point on the intermediate transfer belt 47 can cancel the detection error in the detection values $V_1$ and $V_2$ resulting from points on the intermediate transfer belt 47 and/or the detection error therein caused by change which takes time longer than the predetermined time dt. Consequently, influence of the detection errors in the belt speed on the color misregistration is reduced, and the certainty in reducing the color misregistration is increased.

Examples of the detection error resulting from points on the belt include the detection error caused by the initial accuracy of the distance(s) between the marks constituting the encoder pattern P.

Examples of the detection error caused by change which takes time longer than the predetermined time dt include the detection error caused by change in the distance(s) between the marks constituting the encoder pattern P by temperature change.

It is preferable that the interval between the belt speed detection parts 501*a* and 501*b* be $1/n_1$ (wherein $n_1$ is a positive integer) times the image forming interval $L_2$, as with the interval between the two driven rollers 405 of the first embodiment. The smaller the value of $n_1$ is, the better it is. This is because as the value of $n_1$ is smaller, the color misregistration correction can be controlled at higher accuracy.

Fourth Embodiment

In the following, a fourth embodiment of the present invention is described.

In the third embodiment, the color misregistration is corrected by controlling the speed of the intermediate transfer belt 47 on the basis of the difference value ΔV between the detection values of the speed of the approximately same point on the intermediate transfer belt 47 detected by the belt speed detection parts 501*a* and 501*b*. However, in the fourth embodiment, the color misregistration is corrected by controlling the image forming timings at which the image forming units 40Y, 40M, 40C and 40K form images on the intermediate transfer belt 47 on the basis of the difference value ΔV.

The configuration of the fourth embodiment is the same as that of the image forming apparatus described in the third embodiment. Hence, the description thereof is omitted here, and color misregistration correction control processing in the fourth embodiment is described in the following.

In the image forming apparatus of the fourth embodiment, under the control of the control section 10, the speed of the intermediate transfer belt 47 is detected with a time difference of the predetermined time dt by the belt speed detection parts 501*a* and 501*b* disposed at two points on the moving path of the intermediate transfer belt 47, and the difference value ΔV between the detection values cancels the detection error contained in the detection values. The color misregistration of the toner images formed on the intermediate transfer belt 47 is corrected by controlling the image forming timings of the image forming units 40Y, 40M, 40C and 40K on the basis of the difference value ΔV. Its specific control flow is the same as the flow shown by the flowchart of the color misregistration correction control processing B described in the second embodiment except that the driven roller 405*a* on the upstream side and the driven roller 405*b* on the downstream side are replaced by the belt speed detection part 501*a* on the upstream side and the belt speed detection part 501*b* on the downstream side, respectively.

Thus, in the color misregistration correction control processing in the fourth embodiment, the speed of the intermediate transfer belt 47 is detected with a time difference of the predetermined time dt by the belt speed detection parts 501 disposed at two points on the moving path of the intermediate transfer belt 47, and the image forming timings are controlled on the basis of the difference value ΔV, whereby the color misregistration of the toner images formed on the intermediate transfer belt 47 is corrected. That is, the image forming timings are controlled on the basis of the difference value ΔV between the detection values $V_1$ and $V_2$ of the speed of the approximately same point on the intermediate transfer belt 47 detected by the belt speed detection parts 501 disposed at two points. The difference value ΔV between the detection values $V_1$ and $V_2$ of the speed of the approximately same point on the intermediate transfer belt 47 can cancel the detection error in the detection values $V_1$ and $V_2$ resulting from points on the intermediate transfer belt 47 and/or the detection error therein caused by change which takes time longer than the predetermined time dt. Consequently, influence of the detection errors in the belt speed on the color misregistration is reduced, and the certainty in reducing the color misregistration is increased.

Examples of the detection error resulting from points on the belt include the detection error caused by the initial accuracy of the distance(s) between the marks constituting the encoder pattern P. Examples of the detection error caused by change which takes time longer than the predetermined time dt include the detection error caused by change in the distance(s) between the marks constituting the encoder pattern P by temperature change.

It is preferable that the interval between the belt speed detection parts 501*a* and 501*b* be $1/n_1$ (wherein $n_1$ is a positive integer) times the image forming interval $L_2$, as with the interval between the two driven rollers 405 of the first embodiment. The smaller the value of $n_1$ is, the better it is. This is because as the value of $n_1$ is smaller, the color misregistration correction can be controlled at higher accuracy.

In the third and fourth embodiments, the belt speed detection parts 501 are disposed at two points, the belt speed detection part 501*a* at one point and the belt speed detection part 501*b* at the other point. However, the belt speed detection parts 501 may be disposed at three or more points. Then, it is possible that the belt speed detection parts 501 disposed at two points used for the color misregistration correction control are selected from among all the disposed belt speed detection parts 501 with the operation section 22, and the control section 10 performs the above-described color misregistration correction control processing by using the selected belt speed detection parts 501 disposed at two points.

Fifth Embodiment

In the following, a fifth embodiment of the present invention is described.

In the first to fourth embodiments, the color misregistration is corrected by controlling the speed of the intermediate transfer belt 47 or the image forming timings on the basis of the difference value ΔV between the detection values of the speed of the intermediate transfer belt 47 detected with a time difference of the predetermined time dt by the belt speed detection parts disposed at two points on the moving path of the intermediate transfer belt 47. However, in the fifth embodiment, the color misregistration is corrected by controlling the speed of the intermediate transfer belt 47 on the basis of a time difference Δt between the predetermined time dt and a time required for a mark disposed on the intermediate transfer belt 47 to move from a mark detection part disposed at one point on the moving path of the intermediate transfer belt 47 to a mark detection part disposed at another point thereon.

Figure 11:
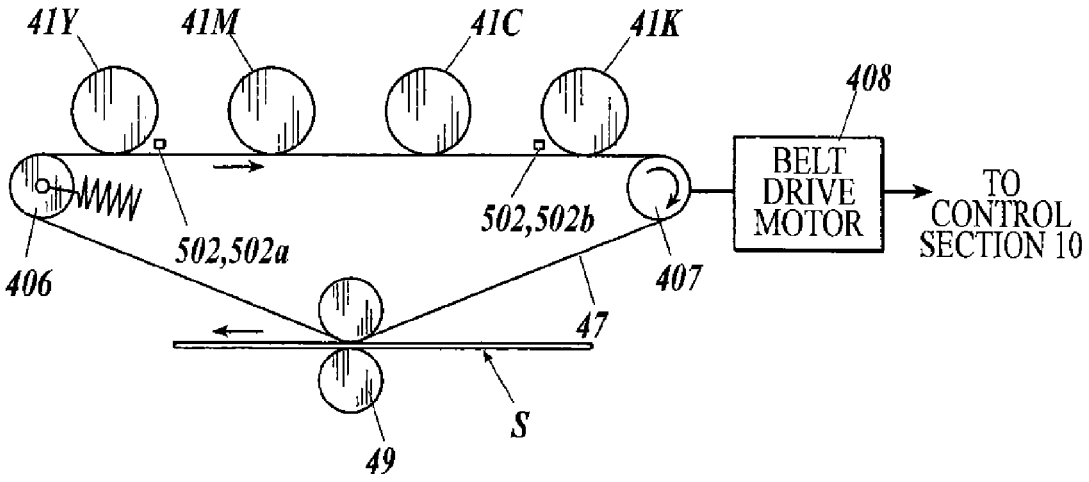
FIG. 11 shows the configuration of the main part of the image forming section in fifth and sixth embodiments in a simplified form, the main part being related to the color misregistration correction control.

The different points in configuration between an image forming apparatus in the fifth embodiment and the image forming apparatus in the first to forth embodiments are that, in the fifth embodiment, as shown in FIG. 11, mark detection parts 502 (a mark detection part 502*a* and a mark detection part 502*b* disposed on the upstream side and the downstream side of the moving path of the intermediate transfer belt 47, respectively) are disposed at two points on the side of the moving path of the intermediate transfer belt 47 between the belt tension adjustment mechanism 406 and the belt drive roller 407, the side where the image forming units 40Y, 40M, 40C and 40K are disposed, and a mark for detection is disposed on the intermediate transfer belt 47. Each mark detection part 502 (502*a* or 502*b*) is connected with the control section 10 via a signal line, and detects the mark's arrival and outputs the result as a detection value to the control section 10.

Other than these, the configuration of the image forming apparatus in the fifth embodiment is the same as that of the image forming apparatus 1 shown in FIGS. 1 to 5. Hence, the description thereof is omitted here, and the same reference numerals are given to the same sections and the like.

Figure 12:
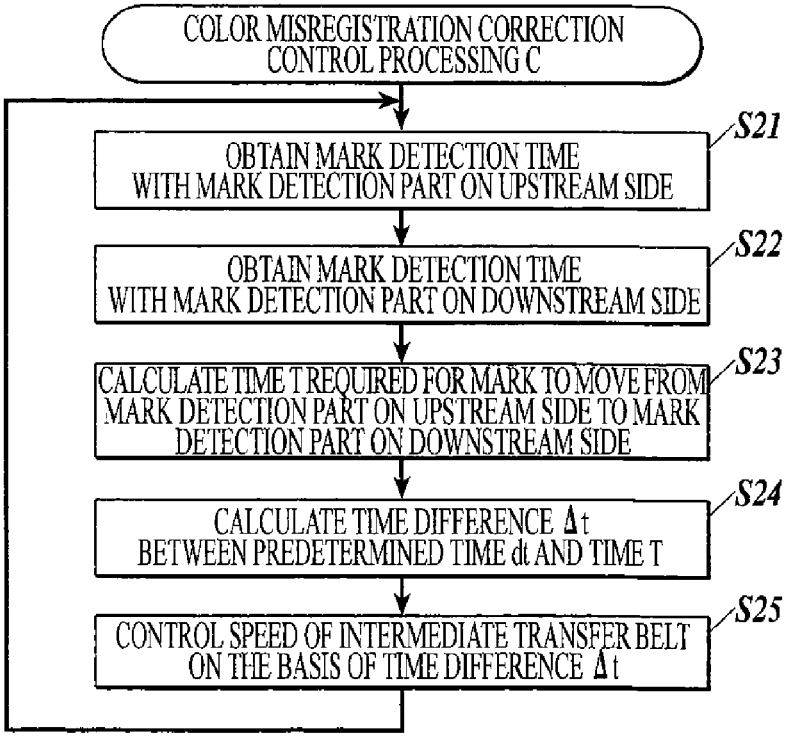
FIG. 12 is a flowchart of color misregistration correction control processing C performed by the control section shown in FIG. 1.

FIG. 12 is a flowchart of color misregistration correction control processing C performed by the control section 10 in the fifth embodiment. The color misregistration correction control processing C shown in FIG. 12 is repeatedly performed from the time the image forming section 40 starts operating until the time the image forming section 40 stops operating. FIG. 12 shows the case where the mark is disposed at one point on the intermediate transfer belt 47.

When receiving a mark detection signal from the mark detection part 502*a* on the upstream side of the moving path of the intermediate transfer belt 47, the control section 10 obtains the current time (i.e. detection time) from a system clock (Step S21). Next, when receiving a mark detection signal from the mark detection part 502*b* on the downstream side of the moving path of the intermediate transfer belt 47, the control section 10 obtains the current time (i.e. detection time) from the system clock (Step S22).

Next, the control section 10 calculates a time difference between the time obtained at Step S21 and the time obtained at Step S22 so as to calculate a time T required for the mark on the intermediate transfer belt 47 to move from the mark detection part 502*a* to the mark detection part 502*b* (Step S23) and calculates the difference value (time difference) between the predetermined time dt and the calculated time T (in the embodiment, Δt=predetermined time dt−time T) (Step S24). The predetermined time dt is an expected value of the time required for the mark on the intermediate transfer belt 47 to move from the mark detection part 502*a* to the mark detection part 502*b*, the mark detection parts 502*a* and 502*b* being disposed at two different points on the moving path of the intermediate transfer belt 47, and is calculated by dividing the interval (distance) between the mark detection parts 502*a* and 502*b* by a target speed of the intermediate transfer belt 47.

Next, the control section 10 controls the speed of the intermediate transfer belt 47 on the basis of the calculated time difference Δt (Step S25). At Step S25, for example, the control section 10 calculates for the belt drive motor 408 a PWM duty cycle with which the time difference Δt becomes a target time difference of 0 by PID control or the like, and drives the belt drive motor 408 at the calculated PWM duty cycle to control the rotational speed of the belt drive roller 407, thereby controlling the speed of the intermediate transfer belt 47. That is, the speed of the intermediate transfer belt 47 is controlled in such a way that the time T required for the mark to move from the mark detection part 502*a* to the mark detection part 502*b* is the predetermined time dt. The control section 10 repeatedly performs Steps S21 to S25 of the color misregistration correction control processing C.

In the flowchart, in order to simplify explanation, the mark is disposed at one point on the intermediate transfer belt 47. However, the marks may be disposed at a plurality of points on the intermediate transfer belt 47 at regular intervals. In this case, when receiving a mark detection signal from each of the mark detection parts 502*a* and 502*b*, the control section 10 obtains the detection time, and correlates and stores the detection time with information indicating that from which mark detection part 502 (502*a* or 502*b*) the mark detection signal is input. When receiving a mark detection signal from the mark detection part 502*b*, the control section 10 reads the detection time of the same mark detected by the mark detection part 502*a*, calculates the time T required for the mark to move from the mark detection part 502*a* to the mark detection part 502*b* and calculates the difference value (time difference) Δt between the predetermined time dt and the calculated time T. Then, the control section 10 controls the speed of the intermediate transfer belt 47 on the basis of the calculated time difference Δt. Any method can be used to detect the same mark. However, because it takes approximately the same time for any points on the intermediate transfer belt 47 to move from the mark detection part 502*a* to the mark detection part 502*b*, in the embodiment, the control section 10 determines, each time a mark is detected by the mark detection part 502*b*, that a mark detected by the mark detection part 502*a* at the time closest to a certain time before is the same as the mark detected by the mark detection part 502*b*.

That is, it is possible that the control section 10 calculates, with respect to each of the marks, the time T required for the mark to move from the mark detection part 502*a* to the mark detection part 502*b* and the time difference Δt between the predetermined time dt and the time T, and controls the speed of the intermediate transfer belt 47 on the basis of the time differences Δt. Consequently, the color misregistration can be finely corrected.

In the fifth embodiment, the configuration is not for detecting the speed of the intermediate transfer belt 47. However, as with the first to fourth embodiments, influence of the detection errors in the belt speed on the color misregistration is reduced and the certainty in reducing the color misregistration is increased, which are not achieved by the conventional arts. The reason is described below.

The difference value ΔV between the detection values of the speed of the intermediate transfer belt 47 detected in the third embodiment can be expressed by the following second formula using the time required for each of two marks 1 and 2 constituting the encoder pattern P to move from a detection point to another detection point.

$$\Delta V=(D/(TA1-TA2)-D/(TB1-TB2)) \quad \text{second formula}$$

In the second formula, D represents the distance between the marks 1 and 2, T represents the detection time, A or B in T represents a point at which the belt speed is detected, and 1, 2, . . . or n in T** represents a number to identify a mark. For example, TA1 represents the detection time of the mark 1 at an A point.

The control to make the difference value ΔV 0 in the third embodiment is equivalent to the following third formula.

$$(D/(TA1-TA2)-D/(TB1-TB2))=0 \quad \text{third formula}$$

This third formula can be transformed as follows.

$$D/(TA1-TA2)=D/(TB1-TB2)$$

$$(TA1-TA2)=(TB1-TB2)$$

$$(TA1-TB1)=(TA2-TB2)$$

In the third embodiment, the time for one mark to move from one detection point to another detection point is the predetermined time dt, and hence the following fourth formula holds.

$$(TA1-TB1)=(TA2-TB2)=\text{predetermined time } dt \quad \text{fourth formula}$$

The fourth formula is equivalent to the control to make the time required for each of the marks 1 and 2 to move from one detection point (B) to another detection point (A) the predetermined time dt (i.e. to make the time difference Δt between the time required for one mark to move from one detection point (B) to another detection point (A) and the predetermined time dt 0) in the fifth embodiment.

The same applies to all the marks, such as the mark 2 and the mark 3, constituting the encoder pattern P. Hence, the control to make the difference value ΔV 0 in the third embodiment is equivalent to the control to make the time required for one mark to move from one detection point to another detection point match the predetermined time dt in the fifth embodiment expressed by the following fifth formula.

$$(TA1-TB1)=(TA2-TB2)==(TAn-TBn)=\text{predetermined time } dt \quad \text{fifth formula}$$

When one mark is disposed on the intermediate transfer belt 47, namely, a mark is disposed at one point on the intermediate transfer belt 47, the fifth formula can be derived from the second formula by taking the detection times at a certain time rotation (the first rotation, for example) of the belt as TA1 and TB1, the detection times at the next time rotation (the second rotation, for example) of the belt as TA2 and TB2, and so forth. That is, even when only one mark is disposed, the control to make the difference value ΔV 0 in the third embodiment is equivalent to the control to make the time required for the one mark to move from one detection point to another detection point match the predetermined time dt in the fifth embodiment expressed by the fourth formula.

As described above, the color misregistration correction control in the fifth embodiment is equivalent to the color misregistration correction control in the third embodiment.

It is preferable that the interval between the mark detection parts 502*a* and 502*b* be $1/n_1$ (wherein $n_1$ is a positive integer) or $n_3$ (wherein $n_3$ is a positive integer) times the image forming interval $L_2$.

Figure 13:
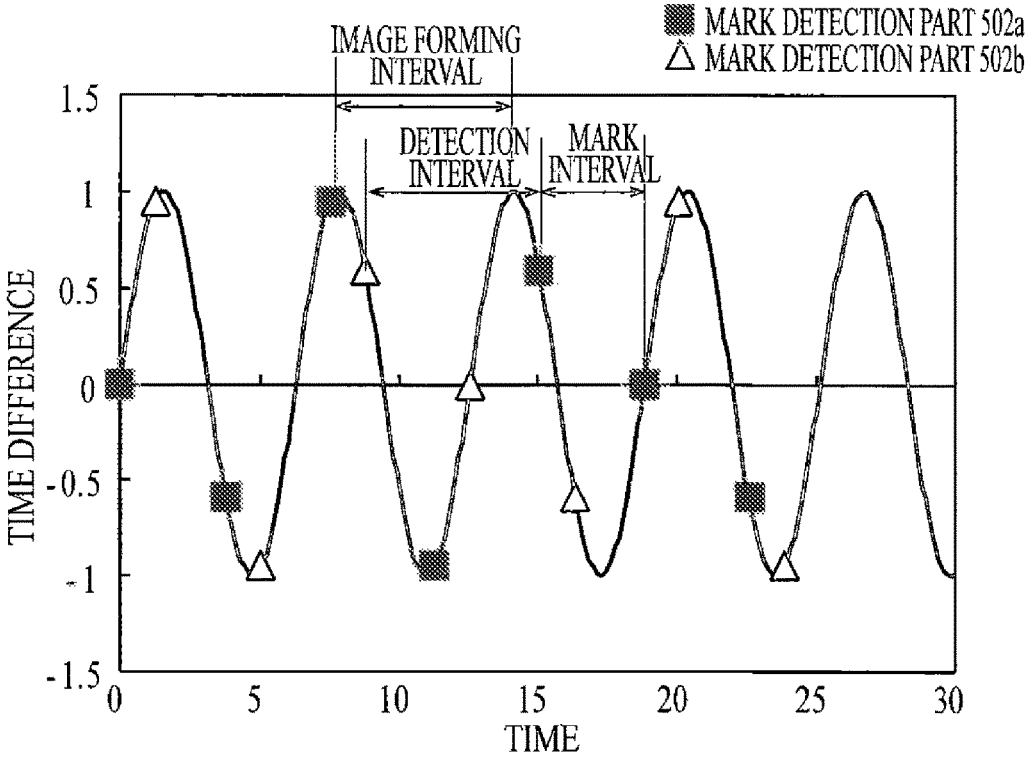
FIG. 13 is a graph to explain a sampling error.

In general, in an image forming apparatus, in order to reduce the color misregistration caused by eccentricity of a belt drive roller or the like, the outer diameter of the belt drive roller and the image forming interval are set in such a way that a belt-feed length by one rotation of the belt drive roller matches the image forming interval. In this case, a cycle of the image forming interval varies. In the graph of FIG. 13, the transverse axis indicates time, and the vertical axis indicates time difference. The solid line indicates "Time required for the belt to move a reference distance (=Target speed×Time)−Time". The square plotted points each represent "Time at which a mark is detected by the mark detection part (502*a*) on the upstream side—Mark position/Target speed", and the triangle plotted points each represent "Time at which a mark is detected by the mark detection part (502*b*) on the downstream side—Mark position/Target speed". The mark position herein is a distance from a certain reference position to the detected mark. The image forming interval in the graph of FIG. 13 is an image forming interval between image forming units next to each other. The mark interval is "Reference interval (distance) between marks/Target speed". The detection interval is an interval between the mark detection parts 502 disposed at two points detecting the same mark.

In general, a sampling interval (mark interval) needs to be a frequency which is two or more (an interval which is ½ or less) times its subject frequency (image forming interval) for non-real time use, and needs to be a frequency which is ten or more times the subject frequency for real time use. In the case where the cycle of the image forming interval greatly varies, when the mark interval is not short enough against the image forming interval, to be more specific, when the mark interval is more than ½ (1/10 for real time use) times the image forming interval (for example, as shown in FIG. 13, the mark interval is 0.6 times the image forming interval), the detection error called a sampling error (aliasing error) occurs, and the marks are detected in a waveform different from the actual one. The sampling error can be cancelled by making the interval between the mark detection parts 502*a* and 502*b* match $n_3$ (wherein $n_3$ is a positive integer) times the image forming interval $L_2$. Therefore, it is preferable that the interval between the mark detection parts 502*a* and 502*b* be $n_3$ (wherein $n_3$ is a positive integer) times the image forming interval $L_2$.

On the other hand, as described above, variation of components having periodicity of the detection interval is not expressed in the difference value. Hence, when the interval between the two mark detection parts 502 is set to be two or more times the image forming interval $L_2$, the color misregistration of the periodic components cannot be reduced. As described in the first embodiment, by making the interval between the two mark detection parts 502 $1/n_1$ (wherein $n_1$ is a positive integer) times the image forming interval $L_2$, the periodic components can be made to be components not causing the color misregistration.

However, when the sampling interval is long, it is difficult to reduce the variation of the periodicity of the detection interval in real time if the detection interval is short. Hence, even though the above-described disadvantage exists, it may be better to set the interval between the two mark detection parts 502 to be two or more times the image forming interval $L_2$ so as to make the detection interval long, whereby it becomes easy to reduce the variation in real time, and also a rate of the detection error independent of points on the belt can be made low, so that the detection accuracy is increased. The detection error independent of points on the belt is, for example, a rise time of a detection signal of a mark detected by the mark detection part 502 is shifted by noise. The rate of such detection error can be made low by making the detection interval long. Therefore, it is preferable that the interval between the two mark detection parts 502 be $1/n_1$ or $n_3$ times the image forming interval $L_2$ when both the advantage and disadvantage are taken into consideration.

Sixth Embodiment

In the following, a sixth embodiment of the present invention is described.

In the fifth embodiment, the color misregistration is corrected by controlling the speed of the intermediate transfer belt 47 on the basis of the time difference Δt between the predetermined time dt and the time T required for the mark on the intermediate transfer belt 47 to move from the mark detection part 502*a* to the mark detection part 502*b*. However, in the sixth embodiment, the color misregistration is corrected by controlling the image forming timings at which the image forming units 40Y, 40M, 40C and 40K form images on the intermediate transfer belt 47 on the basis of the time difference Δt.

The configuration of the sixth embodiment is the same as that described in the fifth embodiment. Hence, the description thereof is omitted here, and color misregistration correction control processing in the sixth embodiment is described in the following.

Figure 14:
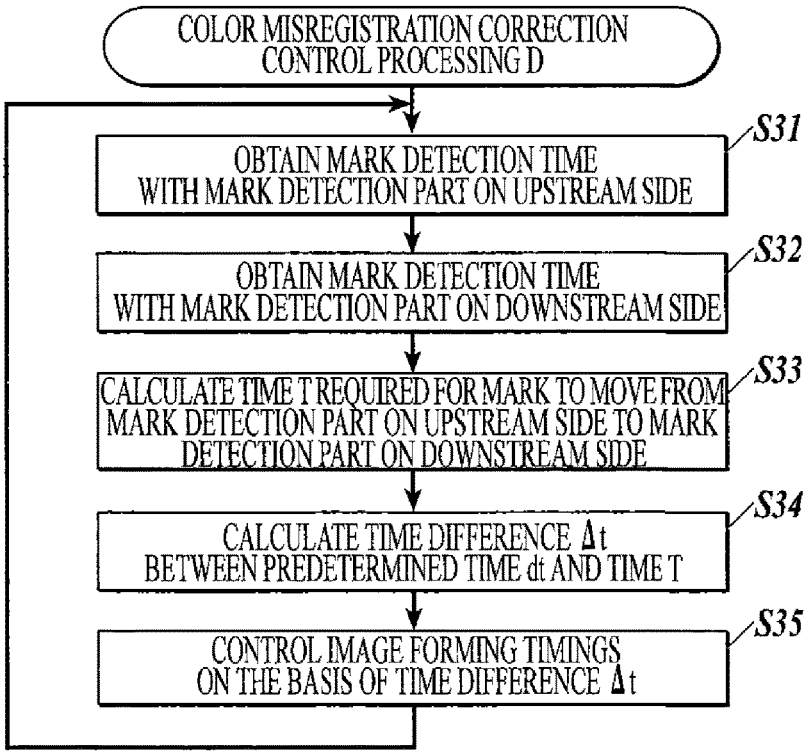
FIG. 14 is a flowchart of color misregistration correction control processing D performed by the control section shown in FIG. 1.

FIG. 14 is a flowchart of color misregistration correction control processing D performed by the control section 10 in the sixth embodiment. The color misregistration correction control processing D shown in FIG. 14 is repeatedly performed from the time the image forming section 40 starts operating until the time the image forming section 40 stops operating.

First, the control section 10 takes Steps S31 to S34 shown in FIG. 14. Steps S31 to S34 are the same as Steps S21 to S24 shown in FIG. 12, respectively. Hence, the description thereof is omitted here. FIG. 14 shows the case where the mark is disposed at one point on the intermediate transfer belt 47.

At Step S35, the control section 10 controls the image forming timings of the image forming units 40Y, 40M, 40C and 40K on the basis of the calculated time difference Δt (Step S35). The image forming timings are controllable, for example, by controlling irradiated points on the photosensitive drums 43Y, 43M, 43C and 43K, the irradiated points to which the exposure units 41Y, 41M, 41C and 41K emit laser beams, and the rotational speeds of the photosensitive drums 43Y, 43M, 43C and 43K. For example, when the time T is shorter than the predetermined time dt (the time difference Δt is positive), on the basis of the time difference Δt, the rotational speeds of the photosensitive drums 43M, 43C and 43K are controlled to be more than their respective predetermined speeds, and the irradiated points on the photosensitive drums 43M, 43C and 43K, the irradiated points to which the exposure units 41M, 41C and 41K emit laser beams, are controlled to move in the rotational directions of the photosensitive drums 43M, 43C and 43K. On the other hand, when the time T is longer than the predetermined time dt (the time difference Δt is negative), on the basis of the time difference Δt, the rotational speeds of the photosensitive drums 43M, 43C and 43K are controlled to be less than their respective predetermined speeds, and the irradiated points on the photosensitive drums 43M, 43C and 43K, the irradiated points to which the exposure units 41M, 41C and 41K emit laser beams, are controlled to move in directions opposite to the rotational directions of the photosensitive drums 43M, 43C and 43K. How much more (or less) than their respective predetermined speeds the rotational speeds of the photosensitive drums 43M, 43C and 43K are made to be is calculated on the basis of the time difference Δt. The irradiated points on the photosensitive drums 43M, 43C and 43K, the irradiated points to which the exposure units 41M, 41C and 41K emit laser beams, are moved by changing angles of the polygon mirrors 411M, 411C and 411K shown in FIG. 2 and/or by changing the laser emission angles from the exposure units 41M, 41C and 41K.

The control section 10 repeatedly performs Steps S31 to S35 of the color misregistration correction control processing D.

It is not essential to change both the rotational speeds of the photosensitive drums 43M, 43C and 43K and the irradiated points with laser beams in order to control the image forming timings. For example, even when only the irradiated points with laser beams are controlled to change, the color misregistration correction effect is obtained.

In the flowchart, in order to simplify explanation, the mark is disposed at one point on the intermediate transfer belt 47. However, the marks may be disposed at a plurality of points on the intermediate transfer belt 47 at regular intervals. In this case, the control section 10 operates as described in the fifth embodiment. That is, it is possible that the control section 10 calculates, with respect to each of the marks, the time T required for the mark to move from the mark detection part 502*a* to the mark detection part 502*b* and the time difference Δt between the predetermined time dt and the time T, and controls the image forming timings on the basis of the time differences Δt. Consequently, the color misregistration can be finely corrected.

Thus, in the sixth embodiment, the color misregistration of the toner images formed on the intermediate transfer belt 47 is corrected by controlling the image forming timings on the basis of the time difference Δt between the predetermined time dt and the time T required for the mark on the intermediate transfer belt 47 to move from the mark detection part 502*a* to the mark detection part 502*b*. Consequently, as with the fifth embodiment, influence of the detection errors in the belt speed on the color misregistration is reduced and the certainty in reducing the color misregistration is increased, which are not achieved by the conventional arts.

It is preferable that the interval between the mark detection parts 502*a* and 502*b* be $1/n_1$ (wherein $n_1$ is a positive integer) or $n_3$ (wherein $n_3$ is a positive integer) times the image forming interval $L_2$, as with the fifth embodiment.

In the fifth and sixth embodiments, the mark detection parts 502 are disposed at two points, the mark detection part 502*a* at one point and the mark detection part 502*b* at the other point. However, the mark detection parts 502 may be disposed at three or more points. Then, it is possible that the mark detection parts 502 disposed at two points used for the color misregistration correction control are selected from among all the disposed mark detection parts 502 with the operation section 22, and the control section 10 performs the above-described color misregistration correction control processing by using the selected mark detection parts 502 disposed at two points.

Figure 16:
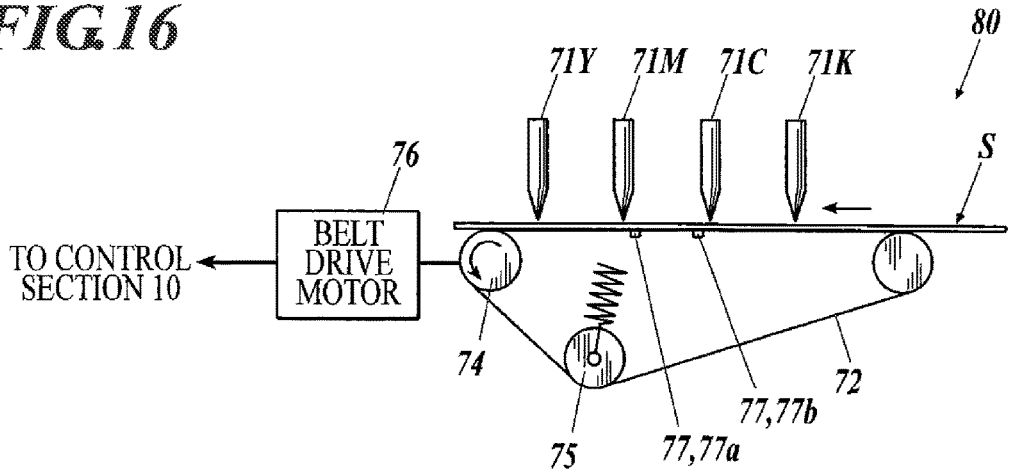
FIG. 16 shows the configuration of the main part of the image forming section in a second modification in a simplified form, the main part being related to the color misregistration correction control.
Figure 17:
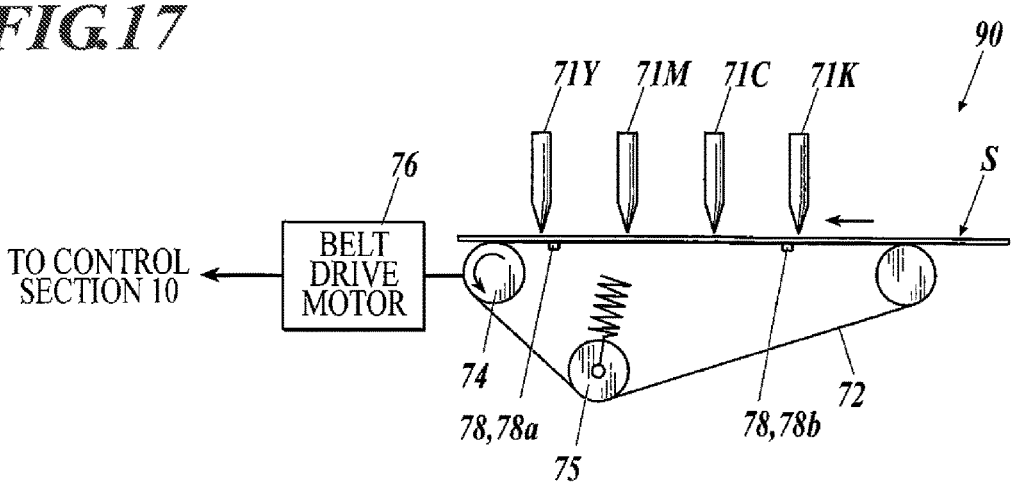
FIG. 17 shows the configuration of the main part of the image forming section in a third modification in a simplified form, the main part being related to the color misregistration correction control.

In the first to sixth embodiments, the present invention is applied to the image forming apparatus having the intermediate transfer belt 47 and successively transferring toner images from the image forming units 40Y, 40M, 40C and 40K to the intermediate transfer belt 47. However, as shown in FIGS. 15 to 17, the present invention is applicable to an image forming apparatus having an image forming section 70 (first modification), an image forming section 80 (second modification) or an image forming section 90 (third modification) and successively transferring toner images from image forming units for respective colors to paper directly.

[First Modification]

Figure 15:
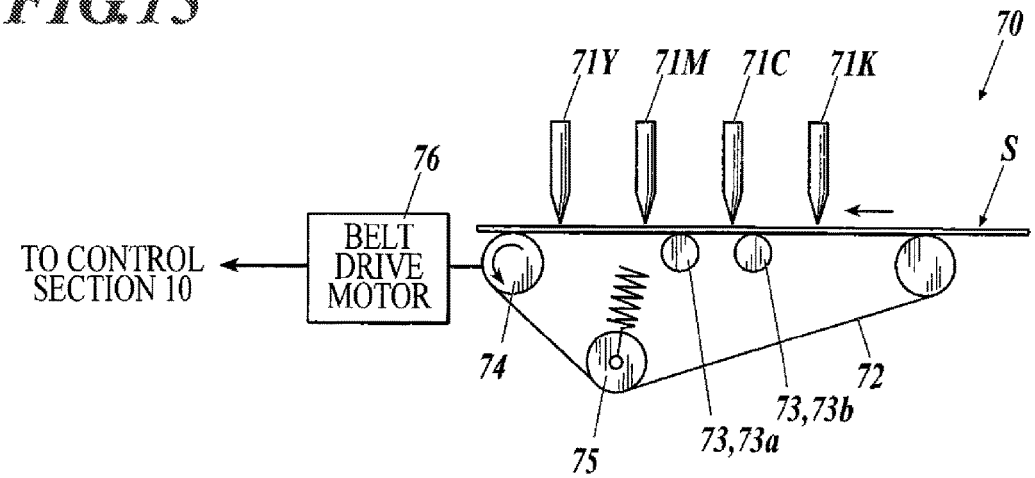
FIG. 15 shows the configuration of the main part of the image forming section in a first modification in a simplified form, the main part being related to the color misregistration correction control.

FIG. 15 shows the configuration of the main part of the image forming section 70 having belt speed detection parts composed of driven rollers, the main part being related to the color misregistration correction control.

As shown in FIG. 15, the image forming section 70 includes print heads 71Y, 71M, 71C and 71K as the image forming units, a conveyor belt 72, driven rollers 73, a belt drive roller 74, a belt tension adjustment mechanism 75 and a belt drive motor 76.

The print heads 71Y, 71M, 71C and 71K are disposed side by side at intervals of a predetermined distance along the moving direction of the conveyor belt 72 which conveys sheets S of paper. The print heads 71Y, 71M, 71C and 71K successively form images on a sheet S conveyed by the conveyor belt 72.

The driven rollers 73 (a driven roller 73*a* and a driven roller 73*b* disposed on the downstream side and the upstream side of the moving path of the conveyor belt 72, respectively) are disposed at two points on a side of the moving path of the conveyor belt 72, the side where the print heads 71 are disposed.

The driven rollers 73*a* and 73*b*, the belt drive roller 74, the belt tension adjustment mechanism 75 and the belt drive motor 76 of the image forming section 70 are the same as those having the same names described in the first embodiment in configuration and function. Hence, the description thereof is omitted here. Further, the other sections and the like of the image forming apparatus, which has the image forming section 70, are the same as those of the image forming apparatus 1. Hence, the description thereof is also omitted here. Further, the contact length (contact angle) of the driven roller 73*a* with the conveyor belt 72 and the contact length of the driven roller 73*b* with the conveyor belt 72 are the same, as described in the first embodiment.

As the color misregistration correction control performed by the control section 10 on the image forming section 70, the color misregistration correction control processing A in the first embodiment or the color misregistration correction control processing B in the second embodiment is performed. The flow of the color misregistration correction control in the first modification is the same as that of the color misregistration correction control processing A in the first embodiment or the color misregistration correction control processing B in the second embodiment except that the intermediate transfer belt 47, the driven rollers 405, the belt drive roller 407, the belt tension adjustment mechanism. 406 and the belt drive motor 408 in the first or second embodiment are replaced by the conveyor belt 72, the driven rollers 73, the belt drive roller 74, the belt tension adjustment mechanism 75 and the belt drive motor 76 in the first modification, respectively. That is, the control section 10 detects the speed of the conveyor belt 72 with a time difference of the predetermined time dt with the driven rollers 73*a* and 73*b* disposed at two points on the moving path of the conveyor belt 72 and controls the speed of the conveyor belt 72 or the image forming timings on the basis of the difference value ΔV between the detection values, thereby performing the color misregistration correction control. Consequently, the image forming section 70 successively transferring toner images from the image forming units for respective colors to paper directly can obtain the same effects as those obtained in the first or second embodiment.

It is preferable that the interval between the driven rollers 73*a* and 73*b* be $1/n_1$ (wherein $n_1$ is a positive integer) times a print head interval(s) (the interval(s) between writing points at which the print heads 71Y, 71M, 71C and 71K write/form images on a sheet S of paper, i.e. an image forming interval), as with the first and second embodiments. Also, it is preferable that the circumference of each driven roller 73 be $1/n_2$ (wherein $n_2$ is a positive integer) times the print head interval, as with the first and second embodiments.

[Second Modification]

FIG. 16 shows the configuration of the main part of the image forming section 80 having belt speed detection parts using the encoder pattern P.

As shown in FIG. 16, the configuration of the image forming section 80 is the same as that of the image forming section 70 shown in FIG. 15 except that the driven rollers 73*a* and 73*b* are replaced by belt speed detection parts 77 (a belt speed detection part 77*a* and a belt speed detection part 77*b* disposed on the downstream side and the upstream side of the moving path of the conveyor belt 72, respectively), and the encoder pattern P is disposed on the back face of the conveyor belt 72 in the image forming section 80.

The belt speed detection parts 77*a* and 77*b*, the belt drive roller 74, the belt tension adjustment mechanism 75 and the belt drive motor 76 of the image forming section 80 are the same as those having the same names described in the third or fourth embodiment in configuration and function. Hence, the description thereof is omitted here. Further, the other sections and the like of the image forming apparatus, which has the image forming section 80, are the same as those of the image forming apparatus 1. Hence, the description thereof is also omitted here.

As the color misregistration correction control performed by the control section 10 on the image forming section 80, the color misregistration correction control processing in the third embodiment or the color misregistration correction control processing in the fourth embodiment is performed. The flow of the color misregistration correction control in the second modification is the same as that of the color misregistration correction control processing in the third embodiment or the color misregistration correction control processing in the fourth embodiment except that the intermediate transfer belt 47, the belt speed detection parts 501, the belt drive roller 407, the belt tension adjustment mechanism 406 and the belt drive motor 408 in the third or fourth embodiment are replaced by the conveyor belt 72, the belt speed detection parts 77, the belt drive roller 74, the belt tension adjustment mechanism 75 and the belt drive motor 76 in the second modification, respectively. That is, the control section 10 detects the speed of the conveyor belt 72 with a time difference of the predetermined time dt with the belt speed detection parts 77*a* and 77*b* disposed at two points on the moving path of the conveyor belt 72 and controls the speed of the conveyor belt 72 or the image forming timings on the basis of the difference value ΔV between the detection values, thereby performing the color misregistration correction control. Consequently, the image forming section 80 successively transferring toner images from the image forming units for respective colors to paper directly can obtain the same effects as those obtained in the third or fourth embodiment.

It is preferable that the interval between the belt speed detection parts 77*a* and 77*b* be $1/n_1$ (wherein $n_1$ is a positive integer) times the print head interval, as with the third and fourth embodiments.

[Third Modification]

FIG. 17 shows the configuration of the main part of the image forming section 90 having mark detection parts.

As shown in FIG. 17, the configuration of the image forming section 90 is the same as that of the image forming section 70 shown in FIG. 15 except that the driven rollers 73*a* and 73*b* are replaced by mark detection parts 78 (a mark detection part 78*a* and a mark detection part 78*b* disposed on the downstream side and the upstream side of the moving path of the conveyor belt 72, respectively), and the mark(s) for detection is disposed on the back face of the conveyor belt 72 in the image forming section 90.

The mark detection parts 78*a* and 78*b*, the belt drive roller 74, the belt tension adjustment mechanism 75 and the belt drive motor 76 of the image forming section 90 are the same as those having the same names described in the fifth or sixth embodiment in configuration and function. Hence, the description thereof is omitted here. Further, the other sections and the like of the image forming apparatus, which has the image forming section 90, are the same as those of the image forming apparatus 1. Hence, the description thereof is also omitted here.

As the color misregistration correction control performed by the control section 10 on the image forming section 90, the color misregistration correction control processing C in the fifth embodiment or the color misregistration correction control processing D in the sixth embodiment is performed. The flow of the color misregistration correction control in the third modification is the same as that of the color misregistration correction control processing C in the fifth embodiment or the color misregistration correction control processing D in the sixth embodiment except that the intermediate transfer belt 47, the mark detection parts 502, the belt drive roller 407, the belt tension adjustment mechanism 406 and the belt drive motor 408 in the fifth or sixth embodiment are replaced by the conveyor belt 72, the mark detection parts 78, the belt drive roller 74, the belt tension adjustment mechanism 75 and the belt drive motor 76 in the third modification, respectively. That is, the control section 10 controls the speed of the conveyor belt 72 or the image forming timings on the basis of the time difference $\Delta t$ between the predetermined dt and the time T required for one mark on the conveyor belt 72 to move from the mark detection part 78*b* to the mark detection part 78*a* disposed at two points on the moving path of the conveyor belt 72, thereby performing the color misregistration correction control. Consequently, the image forming section 90 successively transferring toner images from the image forming units for respective colors to paper directly can obtain the same effects as those obtained in the fifth or sixth embodiment.

It is preferable that the interval between the mark detection parts 78*a* and 78*b* be $1/n_1$ (wherein $n_1$ is a positive integer) or $n_3$ (wherein $n_3$ is a positive integer) times the print head interval, as with the fifth and sixth embodiments. The marks may be disposed at a plurality of points on the conveyor belt 72 instead of one point as with the fifth and sixth embodiments.

In the first to third modifications, the image forming units which form images on paper are composed of print heads. However, the image forming units may be electrophotographic image forming units using photosensitive drums. The electrophotographic image forming units can also perform the control and obtain the effects which are described above. Further, it is possible that the driven rollers 73 in the first modification, the belt speed detection parts 77 in the second modification or the mark detection parts 78 in the third modification are disposed at more than two points, and the control section 10 uses for the color misregistration correction control these disposed at two points selected from among all the disposed ones with the operation section 22.

In the above, the first to sixth embodiments and first to third modifications of the present invention are described. However, these are preferred examples of the image forming apparatus of the present invention, and hence the present invention is not limited thereto.

For example, the encoder patter P or the mark(s) for detection may be disposed on the front face or the back face of the intermediate transfer belt 47 or the conveyor belt 72.

Further, in the embodiments and modifications, the detection values obtained with the belt speed detection parts or the mark detection parts disposed at two points are used for the control to correct the color misregistration (the color misregistration correction control including belt speed control and image forming timing control) in real time. However, the detection values for a predetermined period may be accumulated and stored in the storage section 50, and the control to correct the color misregistration in non-real time may be performed on the basis of the waveforms of the obtained detection values.

Further, in the above, a ROM, a nonvolatile memory, a hard disk or the like is used as a computer readable storage medium of the programs of the present invention. However, this is not a limitation, and hence, for example, a portable storage medium such as a CD-ROM is also usable as the computer readable storage medium. Further, a carrier wave is usable as a medium to provide data of the programs of the present invention via a communication line.

The specific configuration and operation of the image forming apparatus can also be appropriately modified without departing from the scope of the present invention.

This application is based upon and claims the benefit of priority under 35 USC 119 of Japanese Patent Application No. 2013-098942 filed on May 9, 2013, the entire disclosure of which, including the description, claims, drawings and abstract, is incorporated herein by reference in its entirety.

What is claimed is:

1. An image forming apparatus comprising:

an image forming section including a plurality of image forming units disposed side by side along a moving direction of an intermediate transfer belt or a conveyor belt and successively forming images with the image forming units on the intermediate transfer belt or a recording medium conveyed by the conveyor belt;

at least two detection parts disposed on a moving path of the intermediate transfer belt or the conveyor belt on an outer surface of a belt face of the intermediate transfer belt or the conveyor belt which directly faces the image forming units, and detecting a speed of the intermediate transfer belt or the conveyor belt; and a control section which performs color misregistration correction control to correct color misregistration of the images composed of colors to be formed on the intermediate transfer belt or the recording medium conveyed by the conveyor belt on the basis of a detection result of the detection by the detection parts, wherein the control section (a) calculates a difference value between (i) a first speed of the intermediate transfer belt or the conveyor belt detected by, among the at least two detection parts, a first detection part disposed on an upstream side of the moving path and (ii) a second speed of the intermediate transfer belt or the conveyor belt detected by, among the at least two detection parts, a second detection part disposed on a downstream side of the moving path after a predetermined time from a detection time of the detection by the first detection part, the predetermined time being obtained by dividing a distance between the first detection part and the second detection part by a target speed of the intermediate transfer belt or the conveyor belt, and (b) performs the color misregistration correction control on the basis of the calculated difference value.

2. The image forming apparatus according to claim 1, wherein an interval between the detection parts is $1/n_1$ (wherein $n_1$ is a positive integer) times an interval between writing points at which the image forming units form the images on the intermediate transfer belt or the recording medium conveyed by the conveyor belt.

3. The image forming apparatus according to claim 1, wherein the detection parts detect rotational speeds of driven rollers which rotate following the intermediate transfer belt or the conveyor belt so as to detect the speed of the intermediate transfer belt or the conveyor belt on the basis of the detected rotational speeds.

4. The image forming apparatus according to claim 3, wherein an outer circumference of each of the driven rollers is $1/n_2$ (wherein $n_2$ is a positive integer) times an interval between writing points at which the image forming units form the images on the intermediate transfer belt or the recording medium conveyed by the conveyor belt.

5. The image forming apparatus according to claim 3, wherein contact angles of the driven rollers with the intermediate transfer belt or the conveyor belt at the detection parts are equal.

6. The image forming apparatus according to claim 1, wherein the detection parts read a pattern formed on a belt face of the intermediate transfer belt or the conveyor belt so as to detect the speed of the intermediate transfer belt or the conveyor belt.

7. The image forming apparatus according to claim 1, wherein the at least two detection parts are disposed between a belt drive roller which drives the intermediate transfer belt or the conveyor belt and a belt tension adjustment mechanism which adjusts tension of the intermediate transfer belt or the conveyor belt.

8. The image forming apparatus according to claim 1, wherein the control section controls the speed of the intermediate transfer belt or the conveyor belt on the basis of the difference value so as to correct the color misregistration.

9. The image forming apparatus according to claim 1, wherein the control section controls image forming timings at which the image forming units form the images on the intermediate transfer belt or the recording medium conveyed by the conveyor belt so as to correct the color misregistration.

10. The image forming apparatus according to claim 1, wherein the control section performs the color misregistration correction control by controlling the speed of the intermediate transfer belt or the conveyor belt such that the calculated difference value between the first speed and the second speed is zero.

11. A non-transitory computer-readable recording medium encoded with a control program for an image forming apparatus having an image forming section including a plurality of image forming units disposed side by side along a moving direction of an intermediate transfer belt or a conveyor belt and successively forming images with the image forming units on the intermediate transfer belt or a recording medium conveyed by the conveyor belt, and at least two detection parts disposed on a moving path of the intermediate transfer belt or the conveyor belt on an outer surface of a belt face of the intermediate transfer belt of the conveyor belt which directly faces the image forming units, said control program causing a computer to execute:

detecting a first speed of the intermediate transfer belt or the conveyor belt with a first detection part of the at least two detection parts, the first detection part disposed on an upstream side of the moving path;

detecting a second speed of the intermediate transfer belt or the conveyor belt with a second detection part, of the at least two detection parts, disposed on a downstream side of the moving path, after a predetermined time from a detection time of the detected first speed, the predetermined time obtained by dividing a distance between the first detection part and the second detection part by a target speed of the intermediate transfer belt or the conveyor belt;

calculating a difference between the first speed and the second speed; and controlling the speed of the intermediate transfer belt or the conveyor belt based on the calculated difference to perform color misregistration correction.

12. The non-transitory computer-readable recording medium according to claim 11, wherein the at least two detection parts are disposed between a belt drive roller which drives the intermediate transfer belt or the conveyor belt and a belt tension adjustment mechanism which adjusts tension of the intermediate transfer belt or the conveyor belt.

13. The non-transitory computer-readable recording medium according to claim 11, wherein the color misregistration correction is performed by controlling the speed of the intermediate transfer belt or the conveyor belt such that the calculated difference between the first speed and the second speed is zero.

14. A color misregistration correction control method for an image forming apparatus having an image forming section including a plurality of image forming units disposed side by side along a moving direction of an intermediate transfer belt or a conveyor belt and successively forming images with the image forming units on the intermediate transfer belt or a recording medium conveyed by the conveyor belt, and at least two detection parts disposed on a moving path of the intermediate transfer belt or the conveyor belt on an outer surface of a belt face of the intermediate transfer belt of the conveyor belt which directly faces the image forming units, the method comprising:

detecting a first speed of the intermediate transfer belt or the conveyor belt with a first detection part of the at least two detection parts, the first detection part disposed on an upstream side of the moving path;

detecting a second speed of the intermediate transfer belt or the conveyor belt with a second detection part, of the at least two detection parts, disposed on a downstream side of the moving path, after a predetermined time from a detection time of the detected first speed, the predetermined time obtained by dividing a distance between the first detection part and the second detection part by a target speed of the intermediate transfer belt or the conveyor belt;

calculating a difference between the first speed and the second speed; and controlling the speed of the intermediate transfer belt or the conveyor belt based on the calculated difference to perform color misregistration correction.

15. The color misregistration correction control method according to claim 14, wherein the at least two detection parts are disposed between a belt drive roller which drives the intermediate transfer belt or the conveyor belt and a belt tension adjustment mechanism which adjusts tension of the intermediate transfer belt or the conveyor belt.

16. The color misregistration correction control method according to claim 14, wherein the color misregistration correction is performed by controlling the speed of the intermediate transfer belt or the conveyor belt such that the calculated difference between the first speed and the second speed is zero.

* * * * *